US008851623B2

(12) United States Patent
Yokouchi

(10) Patent No.: US 8,851,623 B2
(45) Date of Patent: Oct. 7, 2014

(54) LIQUID EJECTION DEVICE AND MAINTENANCE METHOD THEREOF

(71) Applicant: FUJIFILM Corporation, Tokyo (JP)

(72) Inventor: Tsutomu Yokouchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/791,558

(22) Filed: Mar. 8, 2013

(65) Prior Publication Data

US 2013/0249997 A1 Sep. 26, 2013

(30) Foreign Application Priority Data

Mar. 22, 2012 (JP) ..... 2012-065972

(51) Int. Cl.
*B41J 2/165* (2006.01)

(52) U.S. Cl.
CPC ..... *B41J 2/16517* (2013.01); *B41J 2/16585* (2013.01); *B41J 2/16552* (2013.01)
USPC ..... 347/28

(58) Field of Classification Search
CPC ..... B41J 2002/16555; B41J 29/17
USPC ..... 347/21, 25, 28, 30, 32–35
See application file for complete search history.

(56) References Cited

U.S. PATENT DOCUMENTS

| | | | | |
|---|---|---|---|---|
| 4,563,840 | A * | 1/1986 | Urakami | 451/102 |
| 5,528,271 | A * | 6/1996 | Ebisawa | 347/34 |
| 5,574,485 | A * | 11/1996 | Anderson et al. | 347/27 |
| 5,608,432 | A * | 3/1997 | Yamaguchi | 347/33 |
| 5,883,648 | A * | 3/1999 | Hetzer | 347/33 |
| 6,375,304 | B1 * | 4/2002 | Aldrich et al. | 347/35 |
| 6,631,974 | B2 * | 10/2003 | Shindo | 347/33 |
| 7,244,011 | B2 * | 7/2007 | Matsuba et al. | 347/22 |
| 7,300,141 | B2 * | 11/2007 | Silverbrook | 347/85 |
| 7,419,239 | B2 * | 9/2008 | Brown et al. | 347/25 |
| 7,543,909 | B2 * | 6/2009 | Shimizu | 347/33 |
| 7,575,296 | B2 * | 8/2009 | Yoshida | 347/33 |
| 7,918,530 | B2 * | 4/2011 | Kanfoush et al. | 347/22 |
| 7,980,659 | B2 * | 7/2011 | Sekiyama | 347/33 |
| 8,070,277 | B2 * | 12/2011 | Phillips et al. | 347/90 |
| 8,529,015 | B2 * | 9/2013 | Williams et al. | 347/25 |
| 8,544,991 | B2 * | 10/2013 | Gray et al. | 347/85 |
| 8,556,374 | B2 * | 10/2013 | Gras et al. | 347/25 |
| 8,596,750 | B2 * | 12/2013 | Yu | 347/25 |
| 8,657,407 | B2 * | 2/2014 | Kyotani | 347/30 |
| 2001/0012030 | A1 * | 8/2001 | Midorikawa | 347/33 |
| 2005/0052489 | A1 * | 3/2005 | Kim et al. | 347/29 |
| 2009/0066976 | A1 * | 3/2009 | Uchida et al. | 358/1.7 |

FOREIGN PATENT DOCUMENTS

| | | | |
|---|---|---|---|
| JP | 06198860 | A * | 7/1994 |
| JP | 2002-240308 | A | 8/2002 |
| JP | 2006-321172 | A | 11/2006 |

* cited by examiner

*Primary Examiner* — Alessandro Amari
*Assistant Examiner* — Michael Konczal
(74) *Attorney, Agent, or Firm* — Studebaker & Brackett PC

(57) ABSTRACT

Provided are a liquid ejection device and a maintenance method thereof which are capable of effectively removing, for example, a liquid in a gap between heads. The liquid ejection device includes: a line head which includes a plurality of heads connected to each other in a longitudinal direction and in which a liquid-repellent treatment is performed for a side surface of each head facing an adjacent head; a tube supporting member that is provided between adjacent heads on a side opposite to a liquid ejection surface of the head and supports a tube having one end inserted between the heads; and a gas supply unit that is connected to the other end of the tube and supplies gas between the heads from the one end of the tube.

20 Claims, 24 Drawing Sheets

LIQUID EJECTION DEVICE AND MAINTENANCE METHOD THEREOF

BACKGROUND OF THE INVENTION

1. Field of the Invention

The present invention relates to a liquid ejection device and a maintenance method thereof, and more particularly, to a technique for maintaining a line ink-jet head including a plurality of head units connected to each other.

2. Description of the Related Art

Some ink-jet recording devices which form a color image on a recording medium include a line ink-jet head (line head) in which nozzles are provided over a length corresponding to the overall width of the recording medium.

There is a line head in which a plurality of heads (head modules or head units) are connected to each other. The line head has advantages in that it is expected to improve manufacturing accuracy or manufacturing yield and each head can be replaced when a defect is detected in the manufacturing test or when it needs to be replaced due to the occurrence of a failure or the end of the life span.

In the line head including a plurality of heads connected to each other, a gap is provided in a connection portion for connecting the heads in order to absorb the manufacturing error of each head or a positioning error in assembly.

There are problems that mist which is generated during ink ejection or a liquid, such as a cleaning liquid used to wipe a nozzle surface, is likely to accumulate in the gap between the heads and the liquid falls to the recording medium.

In addition, there is a concern that the liquid which accumulates in the gap will flow to the liquid ejection surface when the liquid ejection surface (nozzle surface) is wiped to contaminate the liquid ejection surface or deteriorate the function of the adhesive on the side surface of the head.

JP2006-321172A discloses an ink-jet recording device in which an ink mist stuck to a nozzle surface flows into the gap between ink-jet recording heads 16A subjected to a hydrophilic process, moves up in the gap, and is absorbed by an upper ink absorption member.

JP2002-240308A discloses a structure in which, when a wiper member for removing a foreign material, such as ink stuck to a nozzle plate, is cleaned, the wiper member is moved to a suction hole with negative pressure and the foreign material is removed by suction.

However, in the structure disclosed in JP2006-321172A, when the side surface of the head is lyophilic, ink is likely to accumulate between the side surfaces (the gap between the heads) of the heads and it is difficult to remove the ink using the absorption of the absorption member.

In a case in which the side surface of the head is liquid-repellent, the contact angle of a liquid with low surface tension, such as ink, is equal to or less than 90° even in a liquid-repellent surface and the ink spreads. It is difficult to completely remove the spread ink using the absorption of the absorption member.

There is a concern that the ink remaining on the side surface of the head will drop from the gap and contaminate the recording medium. Even when the ink does not drop from the gap, for example, the adhesive exposed from the side surface of the head deteriorates, which causes the failure of the head.

SUMMARY OF THE INVENTION

The invention has been made in view of the above-mentioned problems and an object of the invention is to provide a liquid ejection device and a maintenance method thereof capable of effectively removing, for example, a liquid in the gap between heads.

In order to achieve the object, according to an aspect of the invention, a liquid ejection device includes: a line head which includes a plurality of heads connected to each other in a longitudinal direction and in which a liquid-repellent treatment is performed for a side surface of each head facing an adjacent head; a tube supporting member that is provided between adjacent heads on a side opposite to a liquid ejection surface of the head and supports a tube having one end inserted between the heads; and a gas supply unit that is connected to the other end of the tube and supplies gas between the heads from the one end of the tube.

According to the aspect of the invention, in the liquid ejection device including the line head in which a plurality of heads are connected to each other, gas is supplied between adjacent heads to blow a liquid between the heads. Therefore, it is possible to effectively remove the liquid between the heads.

DESCRIPTION OF THE PREFERRED EMBODIMENTS

Hereinafter, embodiments of the invention will be described with reference to the accompanying drawings.

[First Embodiment]

<Overall Structure of Device>

Figure 1:
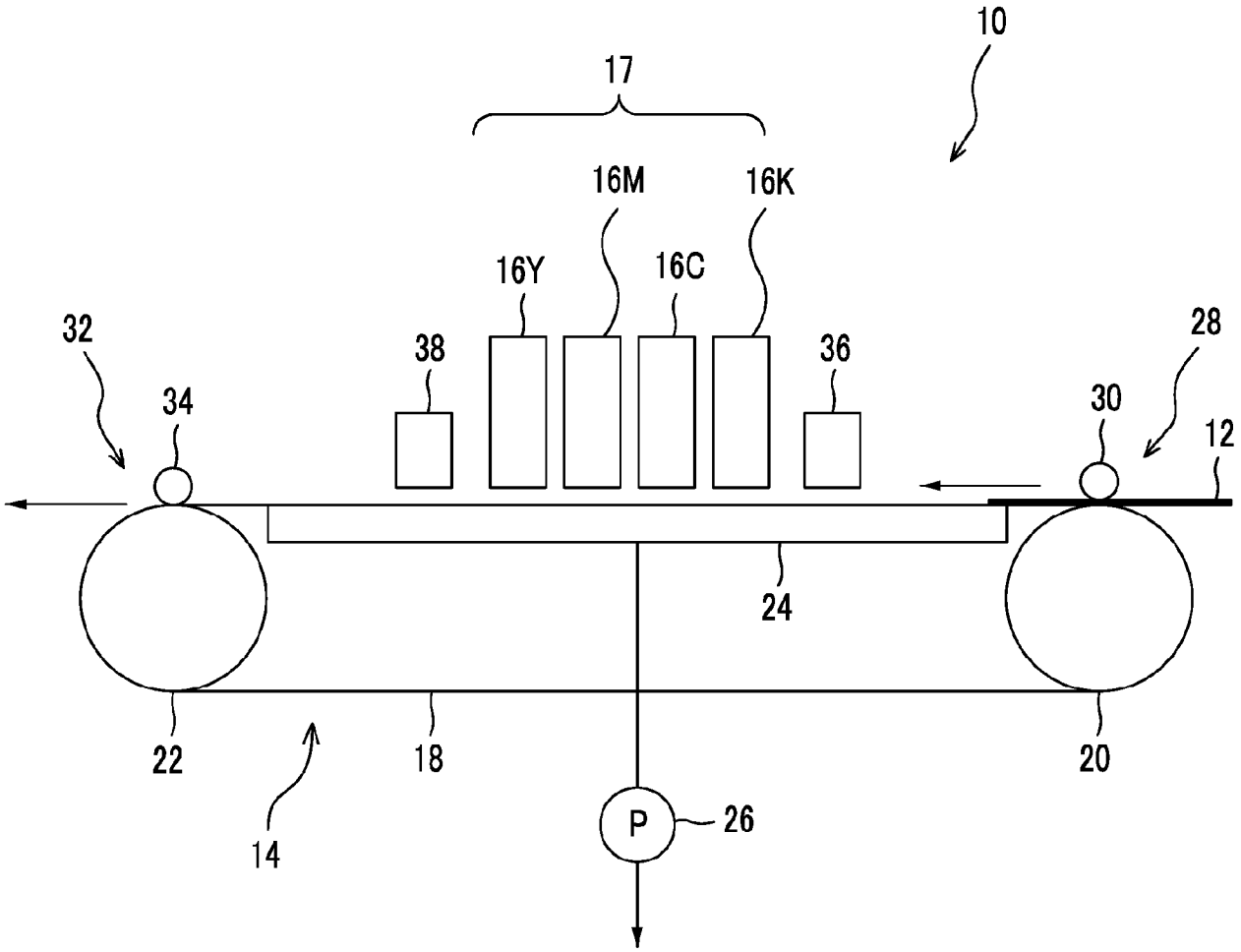
FIG. 1 is a diagram schematically illustrating the overall structure of an ink-jet recording device according to a first embodiment of the invention.

FIG. 1 is a diagram illustrating the overall structure of an ink-jet recording device according to the invention. An ink-jet recording device 10 (liquid ejection device) shown in FIG. 1 is an on-demand ink-jet recording device and includes a recording medium transport unit 14 that holds and transports a recording medium 12 and a printing unit 17 including line heads 16K, 16C, 16M, and 16Y which eject color inks corresponding to K (black), C (cyan), M (magenta), and Y (yellow) to the recording medium 12 held by the recording medium transport unit 14.

Figure 3:
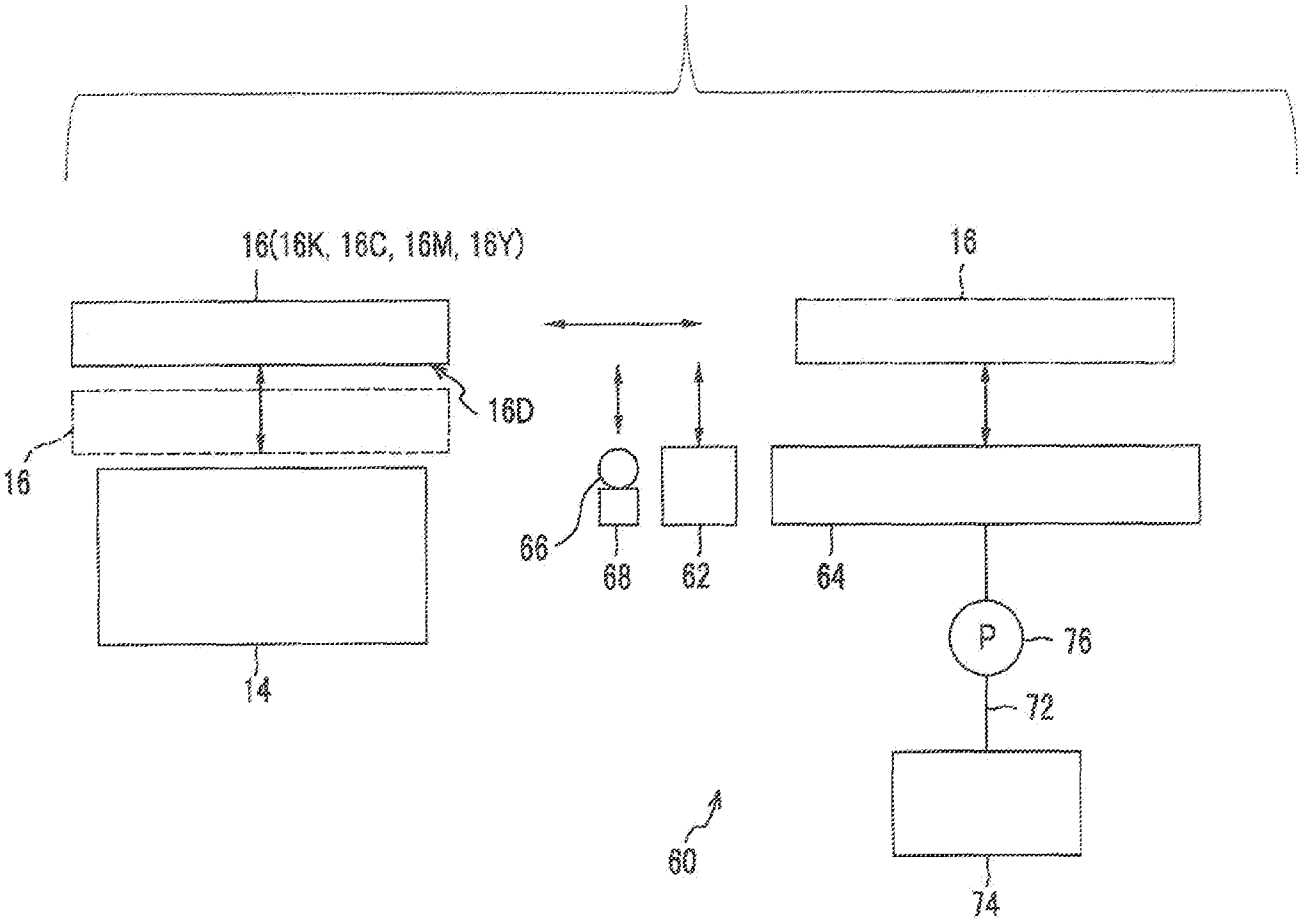
FIG. 3 is a diagram illustrating the schematic structure of a maintenance processing unit.

In addition, the ink-jet recording device 10 includes a maintenance processing unit that performs a maintenance process for the line heads 16K, 16C, 16M, and 16Y, which is not shown In FIG. 1 (see FIG. 3).

The recording medium transport unit 14 includes an endless transport belt 18 in which a plurality of absorption holes (not shown) are provided in a recording medium holding region holding the recording medium 12, transport rollers (a driving roller 20 and a driven roller 22) around which the transport belt 18 is wound, a chamber 24 which is provided on the rear side (a surface opposite to a recording medium holding surface holding the recording medium 12) of the transport belt 18 in the recording medium holding region and communicates with the absorption holes (not shown) provided in the recording medium holding region, and a vacuum pump 26 which generates negative pressure in the chamber 24.

A pressing roller 30 for preventing the floating of the recording medium 12 is provided in a carry-in portion 28 in which the recording medium 12 is carried and a pressing roller 34 is provided in a discharge portion 32 from which the recording medium 12 is discharged.

The recording medium 12 which is carried from the carry-in portion 28 is attracted and held in the recording medium holding region of the transport belt 18 by negative pressure which is applied from the absorption holes provided in the recording medium holding region.

A temperature adjusting unit 36 for adjusting the surface temperature of the recording medium 12 in a predetermined range is provided at a stage before the printing unit 17 (on the upstream side in a recording medium transport direction) on a transport path of the recording medium 12 and a reading device (reading sensor) 38 for reading the image recorded on the recording medium 12 is provided at a stage (on the downstream side in the recording medium transport direction) after the printing unit 17.

The recording medium 12 which is carried from the carry-in portion 28 is attracted and held in the recording medium holding region of the transport belt 18 and the temperature adjusting unit 36 performs a temperature adjusting process for the recording medium 12. Then, the printing unit 17 records an image on the recording medium 12.

As shown in FIG. 1, the line heads 16K, 16C, 16M, and 16Y are arranged in this order from the upstream side in the recording medium transport direction. When the recording medium 12 passes immediately below the line heads 16K, 16C, 16M, and 16Y, K, C, M, and Y inks are ejected onto the recording medium 12 to form a desired color image.

The printing unit 17 is not limited to the above-mentioned structure. For example, the printing unit 17 may include line heads 16LC and 16LM corresponding to LC (light cyan) and LM (light magenta). In addition, the arrangement order of the line heads 16K, 16C, 16M, and 16Y may be appropriately changed.

The reading device 38 reads the image (test pattern) from the recording medium 12 having the image recorded thereon and the recording medium 12 is discharged from the discharge portion 32.

<Structure of Printing Unit>

Figure 2:
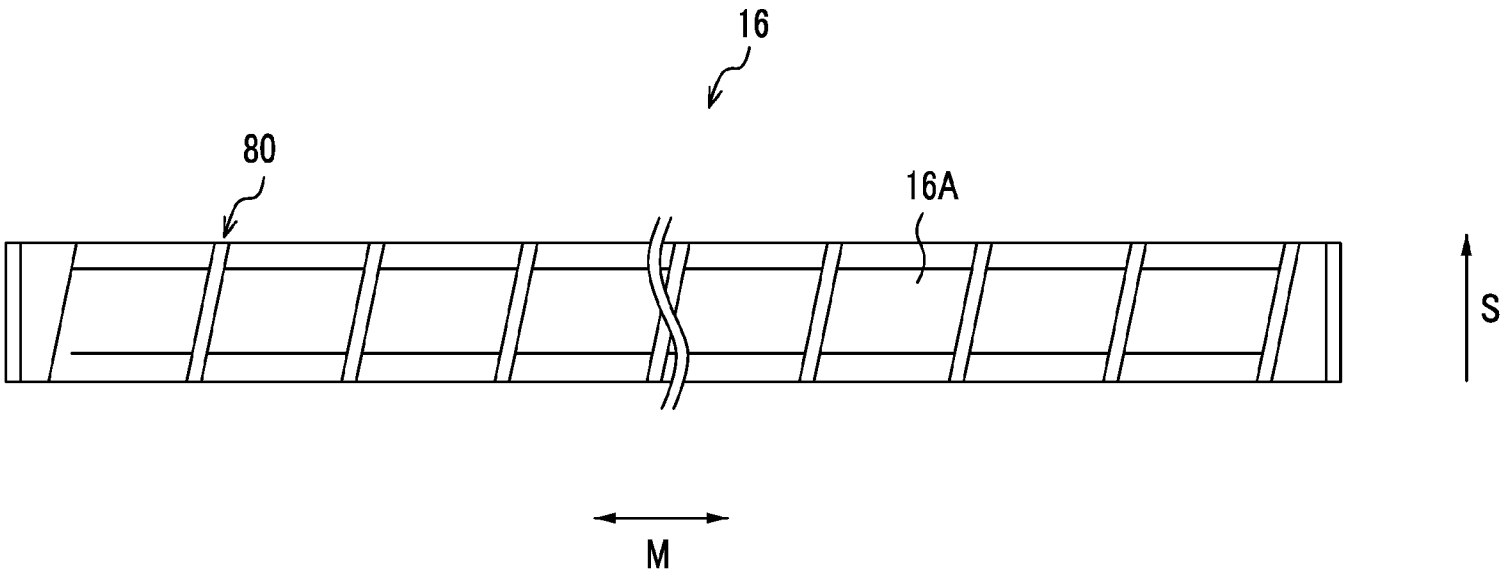
FIG. 2 is a plan view illustrating a line head shown in FIG. 1 as viewed from a nozzle surface.

FIG. 2 is a plan view illustrating an example of the structure of the printing unit 17 and shows the liquid ejection surface of the line head 16 (16K, 16C, 16M, and 16Y) as viewed from an image forming surface of the recording medium 12. In the following description, when it is not necessary to distinguish the line heads 16K, 16C, 16M, and 16Y for each color, the line heads 16K, 16C, 16M, and 16Y are referred to as the line head 16.

As shown in FIG. 2, the line head 16 is a full line head including a plurality of nozzles (not shown) over a length corresponding to the overall width of the recording medium 12 and it is possible to form an image in the entire region of the recording medium 12 with only one scanning operation of the line head 16 relative to the recording medium 12.

The "overall width" of the recording medium 12 is the overall length of the recording medium 12 in a direction (a main scanning direction represented by letter M) perpendicular to the transport direction (a sub-scanning direction represented by letter S) of the recording medium 12 and may be the overall length of an image forming region in the direction when margins are considered.

As shown in FIG. 2, the line head 16 has a structure in which a plurality of ink-jet heads 16A are connected in a line in the longitudinal direction (main scanning direction M). In order to adjust a clearance during assembly, a gap 80 of about several hundreds of micrometers is provided between the heads 16A.

In the gap 80, the side surface (represented by reference numeral 16B in FIG. 20) of each head, which is a surface facing an adjacent head, is a liquid-repellent surface subjected to a liquid-repellent treatment.

The detailed structure of each head 16A is not shown. Each head includes nozzles which eject a liquid, a liquid chamber which communicates with the nozzles, and an ejection force generating element which generates ejection force. The ejection force generating element may be a piezoelectric type in which a piezoelectric element is provided on the wall of a liquid chamber and the liquid chamber is deformed by the flexure deformation of the piezoelectric element to eject the liquid.

In addition, the ejection force generating element may be a thermal type in which a heater is provided in a liquid chamber and heats a liquid in the liquid chamber and the liquid is discharged by a film boiling phenomenon.

The nozzles of each head may be arranged in a matrix. That is, a plurality of nozzles are arranged in an oblique direction which is not perpendicular to the main scanning direction and the nozzle rows in the oblique direction are arranged in the main scanning direction.

When the nozzles are arranged in a matrix, it is possible to increase the actual density of the nozzles in the main scanning direction. The arrangement of the nozzles is not limited to the matrix array, but the nozzles may be arranged in other patterns. For example, the nozzles may be arranged in a line in the main scanning direction or two rows of nozzles may be arranged in zigzag.

<Description of Process of Maintaining Line Head>

FIG. 3 is a schematic diagram illustrating the structure of the maintenance processing unit which performs a maintenance process for the line head 16.

The maintenance processing unit 60 shown in FIG. 3 is arranged at a position to which the line head 16 (16K, 16C, 16M, and 16Y) is horizontally moved from the image forming position on the recording medium transport unit 14 in a direction substantially perpendicular to the transport direction of the recording medium 12.

The maintenance processing unit 60 includes a cleaning device 62 which supplies a cleaning liquid to the liquid ejection surface of the line head 16, a cap unit 64 which performs a purge process or a suction process (a process of ejecting the liquid in the nozzles) for the line head 16, and a wiping processing unit 68 (wiping unit) including a web 66 which performs a wiping process for a liquid ejection surface 16D of the line head 16 subjected to the purge process or the suction process.

The cleaning device 62 and the wiping processing unit 68 may be integrally formed, or the cleaning device 62, the wiping processing unit 68, and the cap unit 64 may be integrally formed. In addition, a blade (wiper) may be provided, instead of a web 66 or in addition to the web 66.

FIG. 3 shows the structure of the maintenance processing unit 60 corresponding to one line head. However, the number of cleaning devices 62, cap units 64, and wiping processing units 68 provided in each line head 16 is equal to the number of line heads 16. In addition, a plurality of cleaning devices 62 may be integrally formed.

In order to move the line head 16 from the image forming position (the line head 16 at the image forming position is represented by a dashed line) immediately above the recording medium transport unit 14 to a maintenance position, the line head 16 is withdrawn from the image forming position on the recording medium transport unit 14 and is then horizontally moved in the direction perpendicular to the transport direction of the recording medium 12.

A known horizontal transport mechanism and a known vertical transport mechanism may be used as movement mechanisms for moving the line head 16 in the vertical direction and the horizontal direction.

The "maintenance position" includes a processing region of the wiping processing unit 68, a processing region of the cleaning device 62, and a processing region of the cap unit 64. In FIG. 3, the line head 16 in the processing region of the cap unit 64 is represented by a one-dot chain line.

When the line head 16 reaches the processing region of the cleaning device 62, the cleaning device 62 is moved upward (or the line head 16 is moved downward) to clean the liquid ejection surface 16D.

When the cleaning process for the liquid ejection surface 16D ends, the line head 16 is moved to the processing region of the cap unit 64. Then, the cap unit 64 comes into close contact with the liquid ejection surface 16D and the suction process or the purge process is performed for the liquid ejection surface 16D.

The cap unit 64 communicates with a waste ink tank 74 through a discharge flow path 72 and a pump 76 is provided on the discharge flow path 72. When the pump 76 is operated with the cap unit 64 coming into close contact with the liquid ejection surface 16D, ink in the line head 16 is sucked through the nozzles.

When the purge or suction process of the line head 16 ends in this way, the line head 16 is moved to the image forming position.

The maintenance process for the line head 16 is performed while the gap 80 between the heads 16A is being cleaned or after the cleaning process.

<Description of Cleaning between Heads>

Figure 4A:
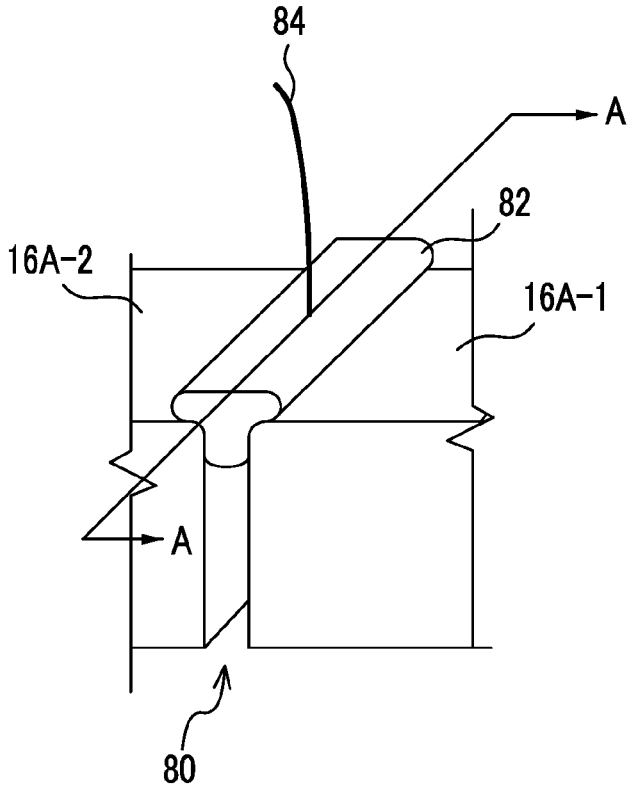
FIG. 4A is a perspective view illustrating an example of the configuration of cleaning between heads.
Figure 4B:
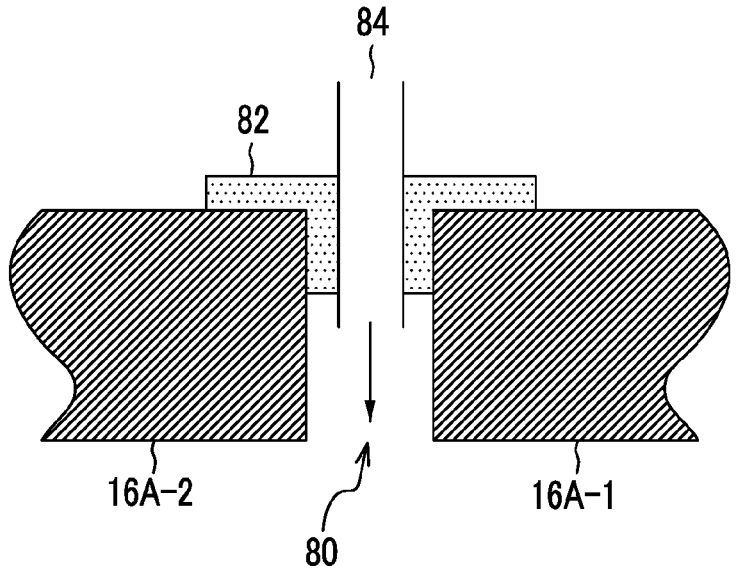
FIG. 4B is a cross-sectional view taken along the line A-A of FIG. 4A.

FIG. 4A is a diagram illustrating an example of the cleaning between the heads and shows a structure between adjacent heads 16A-1 and 16A-2 on the side (the upper side in FIG. 4A) opposite to the liquid ejection surface (not shown in FIGS. 4A and 4B; see FIG. 3) of the line head 16. FIG. 4B is a cross-sectional view taken along the line A-A of FIG. 4A.

As shown in FIGS. 4A and 4B, a tube supporting member 82 is inserted into the gap 80 between the adjacent head 16A-1 and the head 16A-2. The tube supporting member 82 supports an air supply tube 84 (gas supply tube) through which air (the supply direction is represented by an arrow) is supplied to the gap 80 to remove, for example, ink (mist).

The tube supporting member 82 has a shape in which it covers the gap 80 from the side opposite to the liquid ejection surface of each of the heads 16A-1 and 16A-2 and a portion thereof is inserted into the gap 80. The tube supporting member 82 is a flexible rubber member.

The air supply tube 84 is made of a flexible material, such as a fluorine resin, and the diameter of the air supply tube 84 is about half the length of the gap 80.

Figure 6:
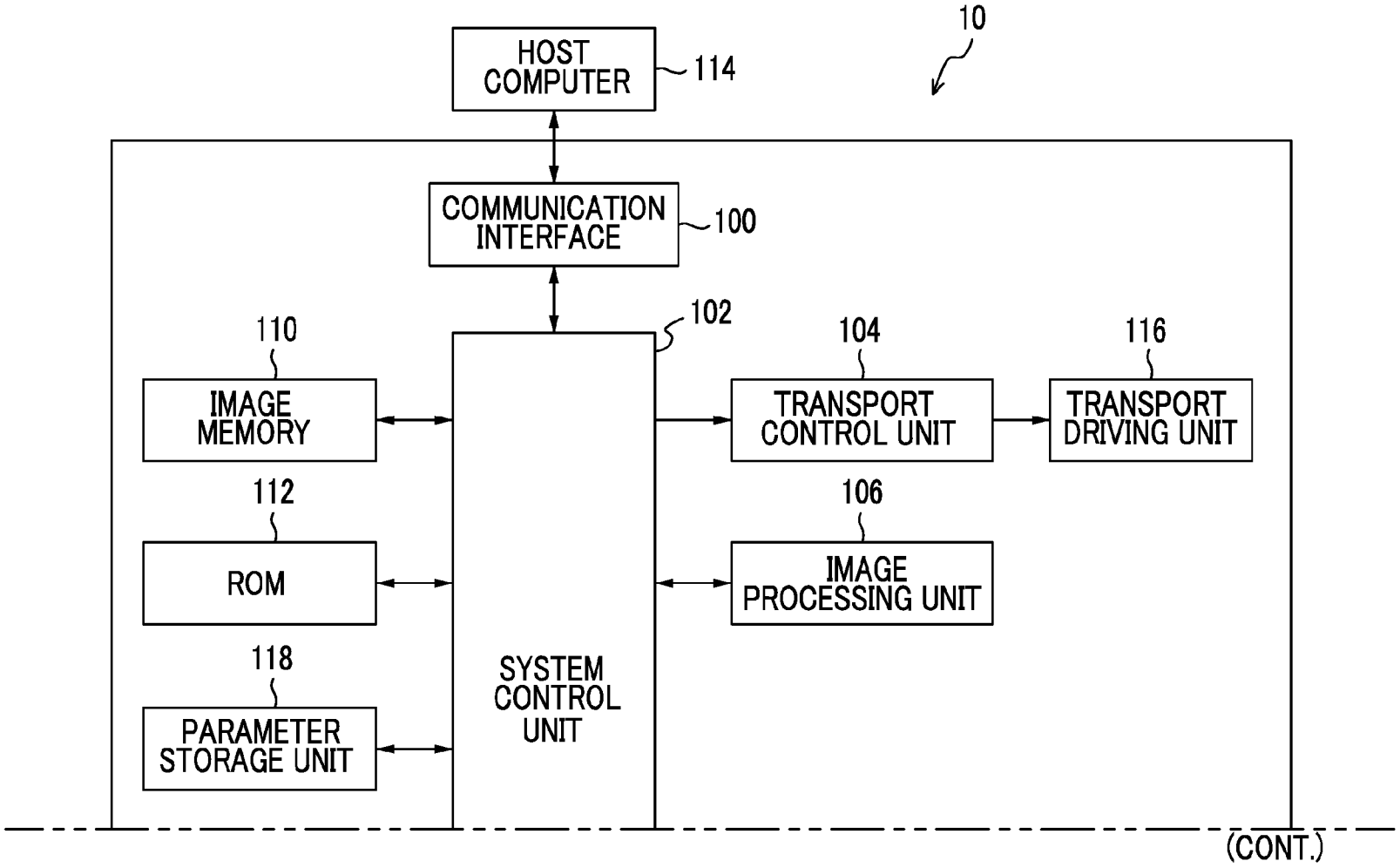
FIG. 6 is a block diagram illustrating the structure of a control system of the ink-jet recording device shown in FIG. 1.
Figure 6:
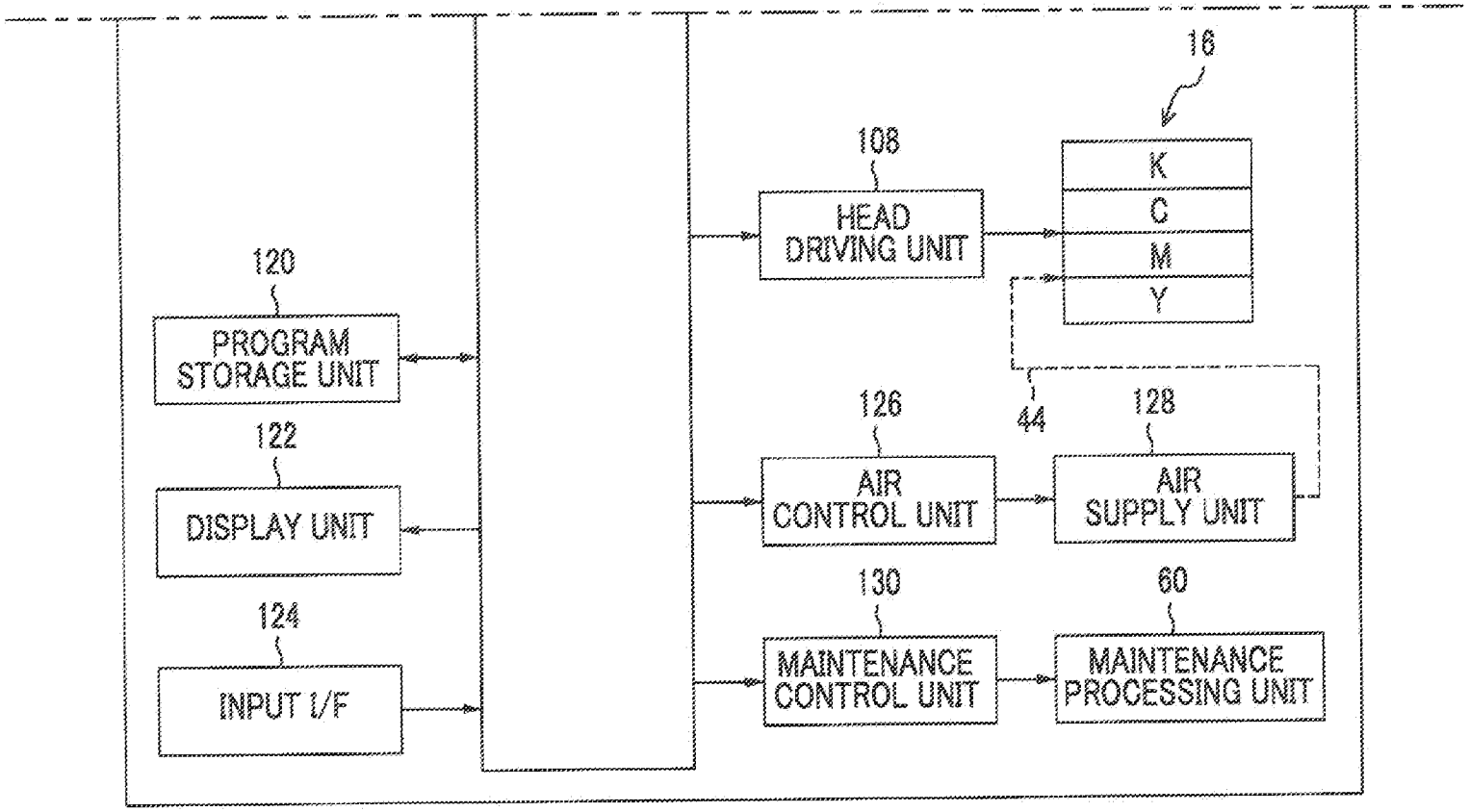

The air supply tube 84 passes through the tube supporting member 82 and has one end which reaches the gap 80 and the other end which is connected to an air supply unit (which is not shown in FIGS. 4A and 4B and is represented by reference numeral 128 in FIG. 6).

Figure 5:
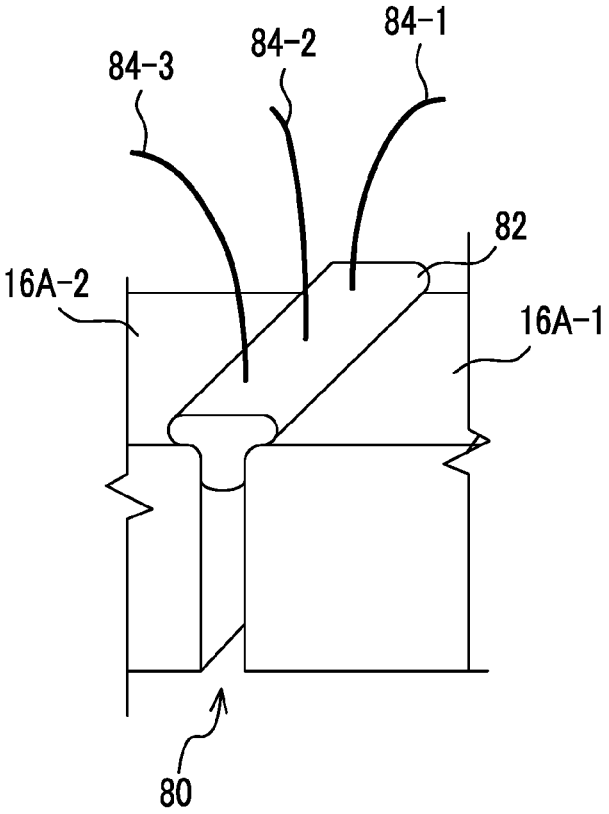
FIG. 5 is a diagram illustrating another example of the structure of the cleaning between the heads.

FIG. 5 is a diagram illustrating an example of the structure of the air supply tube. In the aspect shown in FIG. 5, a plurality of air supply tubes 84-1, 84-2, and 84-3 are provided. In the aspect shown in FIG. 5, it is possible to reliably supply air to the entire gap 80.

The cleaning between the heads is performed after the line head 16 is moved to the processing region of the maintenance processing unit 60. The cleaning between the heads may be performed during the wiping process of the web 66. Alternatively, the cleaning between the heads may be performed while the line head 16 is moved to the position of the cap unit 64 and is then capped.

<Description of Control System>

FIG. 6 is a block diagram illustrating the structure of a control system of the ink-jet recording device shown in FIG. 1. As shown in FIG. 6, the ink-jet recording device 10 includes a communication interface 100, a system control unit 102, a transport control unit 104, an image processing unit 106, a head driving unit 108, an image memory 110, and a ROM 112.

The communication interface 100 is an interface unit which receives raster image data transmitted from a host computer 114. The communication interface 100 may be a serial interface, such as a USB (Universal Serial Bus), or a parallel interface, such as a Centronics interface. The communication interface 100 may include a buffer memory (not shown) for increasing the communication speed.

The system control unit 102 includes a central processing unit (CPU) and peripheral circuits thereof, functions as a control device which controls the overall operation of the ink-jet recording device 10 according to a predetermined program, functions as an arithmetic device which performs various kinds of operations, and functions as a memory controller for the image memory 110 and the ROM 112.

That is, the system control unit 102 controls each unit, such as the communication interface 100 and the transport control unit 104, controls communication with the host computer 114 and the reading and writing of data from and to the image memory 110 and the ROM 112, and generates control signals for controlling each of the units.

Image data transmitted from the host computer 114 is input to the ink-jet recording device 10 through the communication interface 100 and the image processing unit 106 performs predetermined image processing for the image data.

The image processing unit 106 is a control unit which has a signal (image) processing function of performing various processes for generating print control signals from the image data and performing a correction process and supplies the generated print data (dot data) to the head driving unit 108.

When the image processing unit 106 performs necessary signal processing, the amount of liquid droplets (the amount of liquid droplets discharged) ejected from the line head 16 or the ejection timing of the liquid droplets is controlled through the head driving unit 108 on the basis of the print data (half-tone image data).

In this way, a desired dot size or the desired arrangement of dots is obtained. The head driving unit 108 shown in FIG. 6 may include a feedback control system for maintaining the driving conditions of the line head 16.

The transport control unit 104 controls the transport timing and transport speed of the recording medium 12 (see FIG. 1) on the basis of the print data generated by the image processing unit 106. The transport driving unit 116 shown in FIG. 6 includes a motor which drives the driving roller 20 (22) of the recording medium transport unit 14 transporting the recording medium 12 and the transport control unit 104 functions as a driver of the motor.

The image memory (temporary storage memory) 110 functions as temporary storage means for temporarily storing the image data input through the communication interface 100, or functions as an area in which various kinds of programs stored in the ROM 112 are developed and an arithmetic work area (for example, a work area of the image processing unit 106) of the CPU. A volatile memory (RAM) to or from which data can be sequentially read or written may be used as the image memory 110.

The ROM 112 stores, for example, the programs which are executed by the CPU of the system control unit 102, various kinds of data required to control each unit of the device, and control parameters. Data is read from or written to the ROM 112 through the system control unit 102. The ROM 112 is not limited to a memory formed by a semiconductor element, but may be a magnetic medium, such as a hard disk. In addition, an external interface may be provided and a removable storage medium may be used.

The parameter storage unit 118 stores various kinds of control parameters required for the operation of the ink-jet recording device 10. The system control unit 102 appropriately reads parameters required for control and updates (rewrites) various kinds of parameters, if necessary.

The program storage unit 120 is storage means for storing a control program for operating the ink-jet recording device 10. When each unit of the device is controlled, the system control unit 102 (or each unit of the device) reads a necessary control program from the program storage unit 120 and executes the control program.

The display unit 122 is means for displaying various kinds of information transmitted from the system control unit 102. A general-purpose display device, such as an LCD monitor, is applied to the display unit 122. As the display form of the display unit 122, a lamp may be turned on (blinked or turned off). In addition, a sound (voice) output unit, such as a speaker, may be provided.

An information input unit, such as a keyboard, a mouse, or a joystick, is applied to an input interface (I/F) 124. Information input through the input interface 124 is transmitted to the system control unit 102.

The air control unit 126 (a component of the gas supply unit) controls the air supply unit 128 (a component of the gas supply unit) on the basis of the control signal transmitted from the system control unit 102. The air supply unit 128 includes an air tank, a compression unit (compressor) which compresses air, a pipe serving as an air flow path, and a joint which is a connection portion to the air supply tube 84.

Air is supplied from the air supply unit 128 to the gap (see FIG. 4) between the heads 16A of the line head 16 through the air supply tube 84, and ink infiltrated from the liquid ejection surface into the gap 80 or the cleaning liquid used to clean the liquid ejection surface is blown to the outside of the gap 80.

The supply of air is controlled by pressure or the flow rate. For example, in the control of air supply by pressure, pressure is equal to or less than 100 kPa in order to prevent damage of the air supply tube 84 or damage due to the leakage of air from the joint.

Pressure is preferably equal to or more than 10 kPa and equal to or less than 30 kPa and is appropriately adjusted according to the length or diameter of the air supply tube 84. In addition, in the control of air supply by the flow rate, the flow rate is controlled in the range of several hundreds of milliliters per minute to one liter per minute.

When dry air (dry gas) is supplied from the air supply unit 128, it is possible to dry the gap 80 between the heads 16A. As such, when the gap 80 between the heads 16A is dried, the deterioration of, for example, an adhesive is prevented.

The term "dry air" means air with a relative humidity of 20 percent or less and preferably a relative humidity of 10 percent or less.

As an example of the generation of dry air, a dehumidification unit (drying unit) which performs a dehumidification process for the air supplied from the air supply unit 128 is provided. The dehumidification unit may be any one of a compression type, a cooling type, a suction type, and an absorption type.

The dehumidification unit may be formed integrally with the air supply unit 128 or it may be provided between the air supply unit 128 and the gap 80 between the heads 16A separately from the air supply unit 128.

The maintenance control unit 130 controls the operation of the maintenance processing unit 60 shown in FIG. 3 in response to a command signal transmitted from the system control unit 102. That is, the maintenance control unit 130 controls, for example, the lifting of the cap unit 64 of the cleaning device 62 shown in FIG. 3, the turning on and off of the pump 76, the number of revolutions of the pump 76, and the lifting of the web 66.

According to the ink-jet recording device 10 having the above-mentioned structure, air is supplied to the gap 80 between the heads 16A of the line head 16 to blow, for example, ink or mist in the gap 80. Therefore, even when it is difficult to remove the ink using suction, it is possible to effectively remove the liquid in the gap 80.

[Second Embodiment]

Next, a second embodiment of the invention will be described. In the second embodiment, the same or similar components as those in the first embodiment are denoted by the same reference numerals and the description thereof will not be repeated.

<Example of Configuration of Cleaning between Heads>

Figure 7:
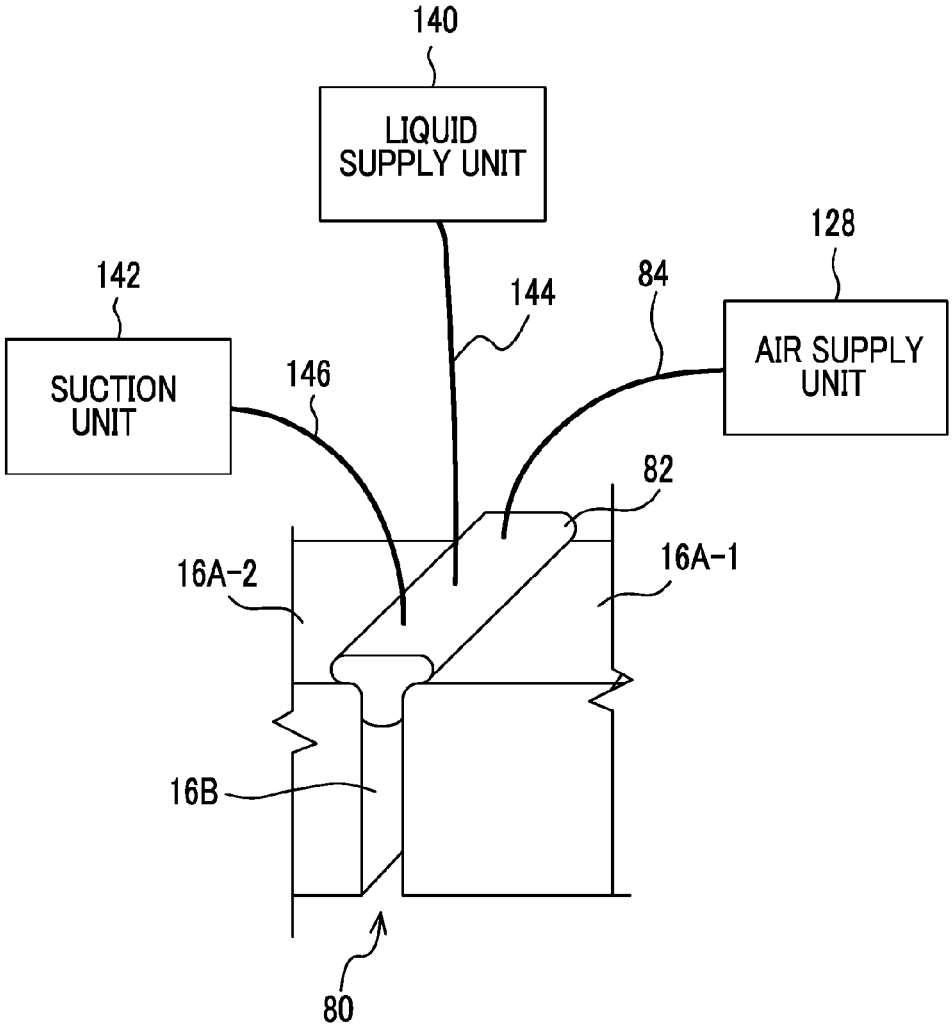
FIG. 7 is a diagram illustrating an example of the configuration of cleaning between heads in an ink-jet recording device according to a second embodiment of the invention.

FIG. 7 is a diagram illustrating an example of the configuration of cleaning between heads in an ink-jet recording device according to the second embodiment. In the aspect shown in FIG. 7, the ink-jet recording device includes an air supply unit 128 which supplies air to a gap 80 (a side surface 16B of a head 16A) between the heads 16A, a liquid supply unit 140 (a component of a liquid supply unit) which supplies a liquid to the gap 80, and a suction unit 142 (a component of a suction unit) which performs suction from the gap 80. One end of an air supply tube 84, one end of a liquid supply tube 144 (liquid supply tube), and one end of a suction tube 146 are inserted into the gap 80.

The air supply tube 84, the liquid supply tube 144, and the suction tube 146 shown in FIG. 7 are supported by a tube supporting member 82.

The liquid supply unit 140 includes, for example, a liquid tank which stores the liquid to be supplied to the gap 80 between the heads 16A, a liquid supply pump, a pipe which functions as a liquid flow path, and a joint connected to the other end of the liquid supply tube 144. In addition, the liquid supply unit 140 may include a filter which removes a foreign material in the liquid and a sensor which detects the temperature and flow rate of the liquid.

For example, water (pure water) or a cleaning liquid may be used as the liquid to be supplied to the gap 80 between the heads 16A.

The supply of the liquid is controlled by pressure or the flow rate. For example, in the control of air supply by pressure, pressure is equal to or less than 100 kPa in order to prevent damage of the liquid supply tube 144 or damage due to the leakage of the liquid from the joint.

Pressure is preferably equal to or more than 10 kPa and equal to or less than 30 kPa and is appropriately adjusted according to the length or diameter of the liquid supply tube 144. In addition, in the control of air supply by the flow rate, the flow rate is controlled in the range of 0.5 milliliters per minute to 5 liters per minute.

The suction unit 142 includes, for example, a suction pump, a pipe which functions as a suction flow path, and a joint connected to the other end of the suction tube 146. In addition, the suction unit 142 may include, for example, a pressure sensor.

Similarly to the air supply tube 84, the liquid supply tube 144 and the suction tube 146 are made of a flexible material, such as a fluorine resin. The shape, such as the diameter, and the structure of the liquid supply tube 144 and the suction tube 146 may be the same as those of the air supply tube 84 and may be determined considering conditions, such as the flow rate and suction pressure of the liquid.

The suction of air is controlled by pressure or the flow rate. For example, in the control of air suction by pressure, pressure is equal to or more than −100 kPa in order to prevent damage of the suction tube 146 or damage due to the leakage of air from the joint when pressure in air supply has a positive value.

Pressure is preferably equal to or more than −30 kPa and equal to or less than −10 kPa and is appropriately adjusted according to the length or diameter of the suction tube 146. In addition, in the control of air suction by the flow rate, the flow rate is controlled in the range of several hundreds of milliliters per minute to one liter per minute.

Figure 8:
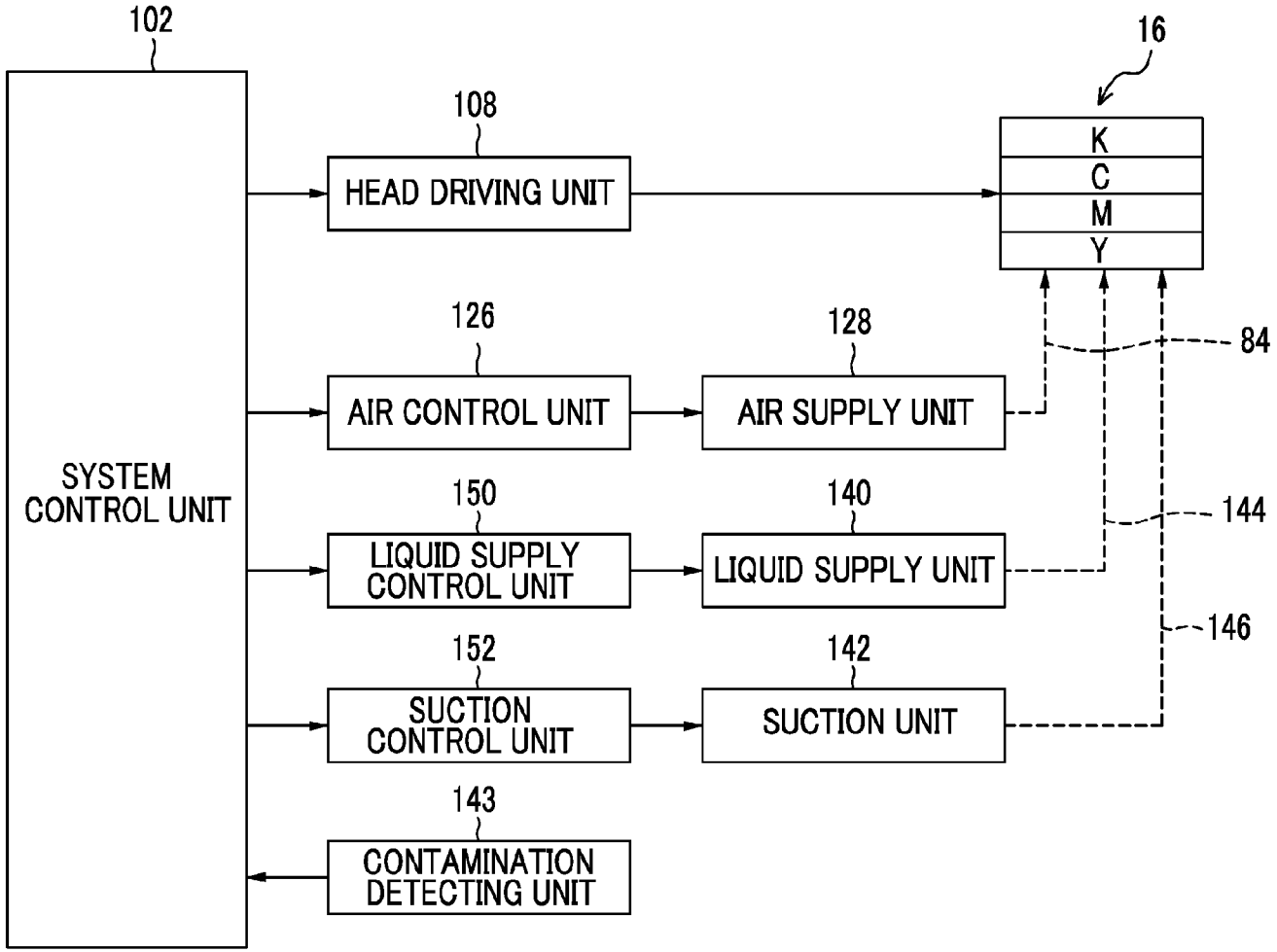
FIG. 8 is a block diagram illustrating the schematic structure of a control system of the ink-jet recording device according to the second embodiment of the invention.

FIG. 8 is a block diagram illustrating the schematic structure of a control system of the ink-jet recording device according to this embodiment. In FIG. 8, some of the components shown in FIG. 6 are not shown and components related to the cleaning between the heads are mainly shown.

As shown in FIG. 8, a liquid supply control unit 150 (a component of the liquid supply unit) controls the operation of the liquid supply unit 140 on the basis of a command signal transmitted from a system control unit 102. In addition, a suction control unit 152 (a component of the suction unit) controls the operation of the suction unit 142 on the basis of a command signal transmitted from a system control unit 102.

In FIG. 8, dashed lines indicate the air supply tube 84, the liquid supply tube 144, and the suction tube 146.

A contamination detecting unit 143 detects the degree of contamination of the liquid supplied from the liquid supply unit 140 to the gap 80 between the heads 16A in the cleaning between the heads. The detection result is transmitted to the system control unit 102 and it is determined whether the liquid supplied to the gap 80 between the heads 16A is clean (which will be described in detail below).

<Control Flow>

Figure 9:
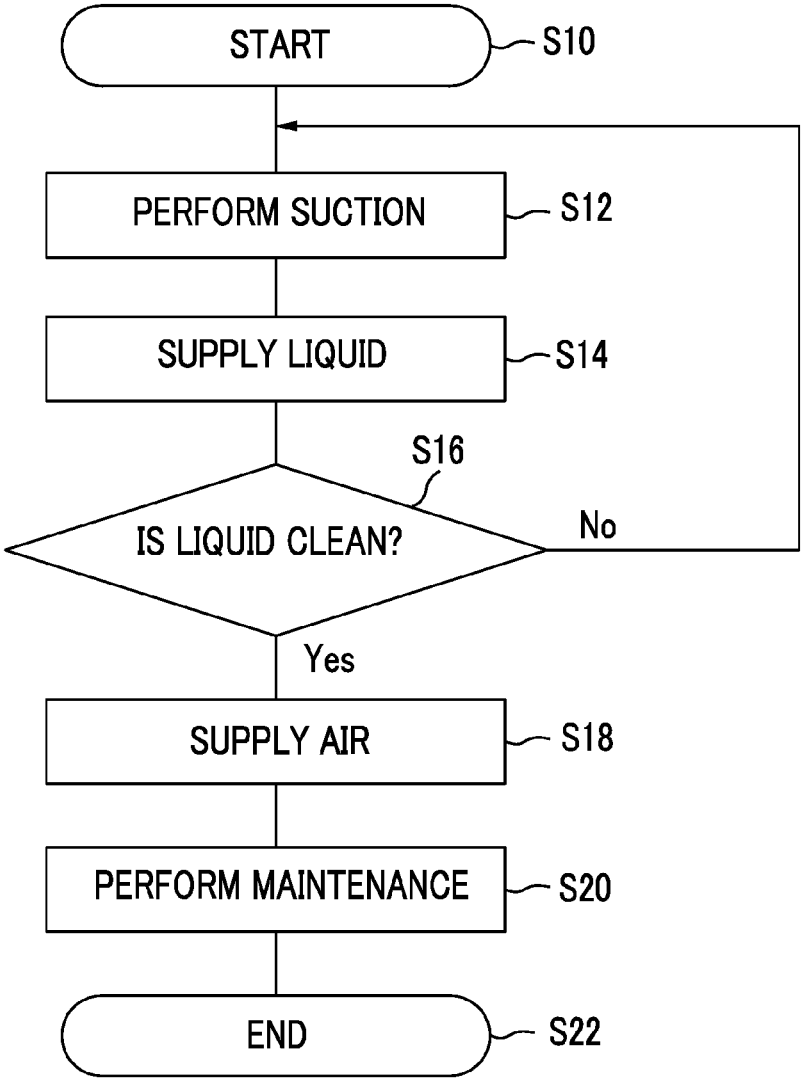
FIG. 9 is a flowchart illustrating the flow of the cleaning between the heads.

FIG. 9 is a flowchart illustrating the flow of the cleaning between the heads according to this embodiment. When the cleaning between the heads starts (Step S10), the suction unit 142 is operated to perform suction from the gap 80 between the heads 16A (Step S12: a suction process).

For example, a liquid with relatively high surface tension, such as water, can be removed by suction. If necessary, suction may be adjusted. For example, slow suction may be performed.

Then, the liquid is supplied from the liquid supply unit 140 to the gap 80 between the heads 16A (Step S14: a liquid supply process). Ink (solidified ink) stuck to the side surface of each head is removed by the supply of the liquid. When water is used as the liquid, it is possible to effectively remove, for example, ink stuck to the side surface of each head since water has high surface tension and flows naturally without spreading.

When considering water being used as the liquid, a liquid-repellent treatment (liquid-repellent film) with a large static contact angle and a large dynamic contact angle (for example, a small water sliding angle) may be selected for the side surface of the head.

When the liquid is supplied, the cleaning state of the side surface of the head is detected (Step S16). In the process, the contamination of the liquid which flows out from the gap 80 between the heads 16A is detected at a predetermined time interval. When the contamination is greater than a predetermined threshold value (No), Steps S12 and S14 are performed again.

On the other hand, when the contamination is equal to or less than the threshold value (Yes), the process proceeds to Step S18. In Step S18, air is supplied to the gap 80 between the heads 16A and the contaminant in the gap 80 is blown by the air (gas supply process).

Then, the process proceeds to Step S20 and a maintenance process is performed for the line head 16 (Step S20). Then, a cleaning sequence ends (Step S22).

That is, for example, ink which is less likely to be removed by suction is blown by air. For example, when thick ink is blown, the inside of the device becomes contaminated. Therefore, water or a cleaning liquid may flow to thin the ink, thereby minimizing the internal contamination of the device.

Even when a liquid including the blown ink is stuck to the liquid ejection surface, the liquid stuck to the liquid ejection surface is removed by the subsequent maintenance process. In addition, the process may be combined with the maintenance process for the line head 16 to improve the removal efficiency of ink from the gap 80 between the heads 16A.

Figure 10:
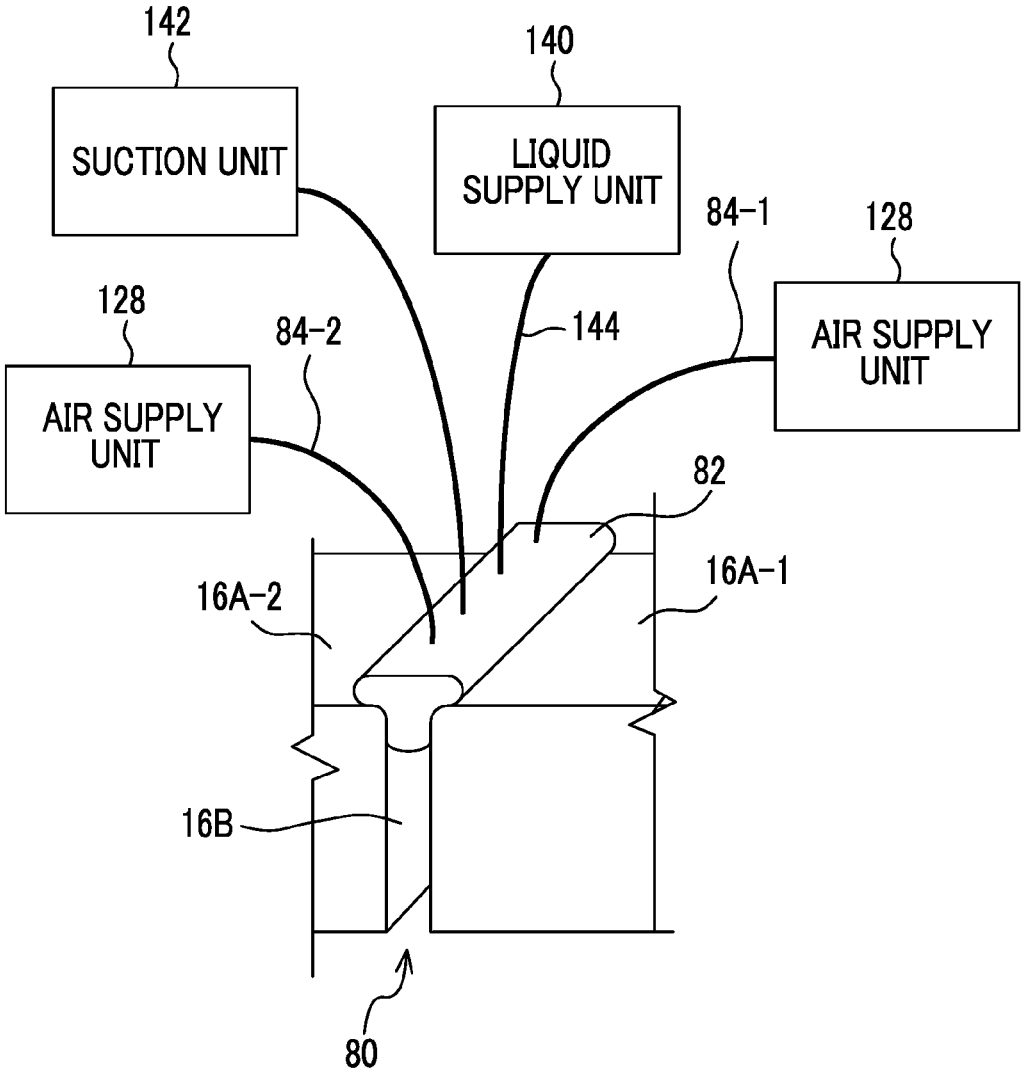
FIG. 10 is a diagram illustrating another example of the structure of the cleaning between the heads.

FIG. 10 is a diagram illustrating another example of the structure of the cleaning between the heads. In the aspect shown in FIG. 10, air supply tubes 84-1 and 84-2 are arranged at both ends of the gap 80 between the heads 16A in the lateral direction. This structure can reliably blow ink in the gap 80 between the heads 16A.

According to the second embodiment, the supply and suction of the liquid are performed in addition to the supply of air. Therefore, it is possible to reliably and effectively remove, for example, ink in the gap 80 between the heads 16A.

[Third Embodiment]

Next, a third embodiment of the invention will be described.

<Example of Configuration of Cleaning between Heads>

Figure 11:
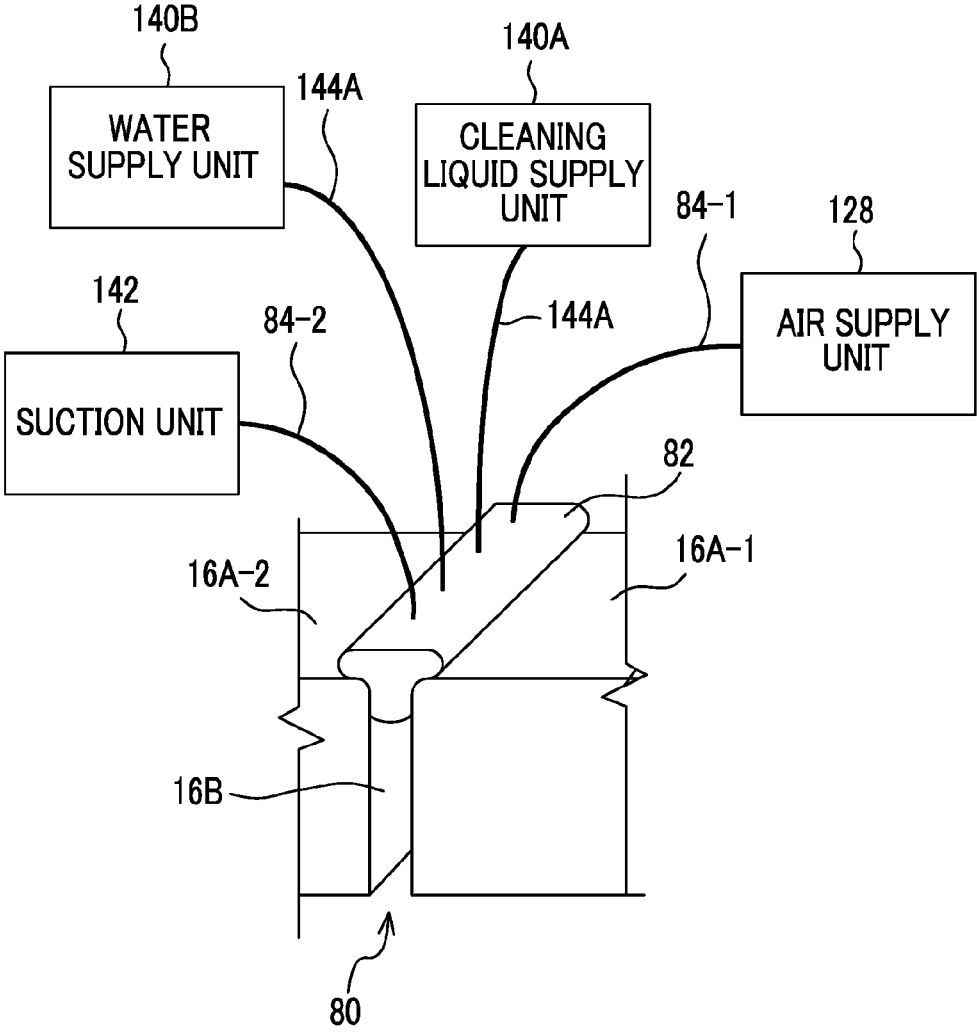
FIG. 11 is a diagram illustrating an example of the configuration of cleaning between heads in an ink-jet recording device according to a third embodiment of the invention.

FIG. 11 is a diagram illustrating an example of the configuration of cleaning between heads in an ink-jet recording device according to a third embodiment of the invention. In the aspect shown in FIG. 11, the liquid supply unit 140 shown in FIG. 7 includes a cleaning liquid supply unit 140A (a component of a cleaning liquid supply unit) and a water supply unit 140B (a component of a water supply unit).

Since a cleaning liquid with relatively low surface tension spreads to the side surface of the head 16A, it is possible to effectively remove, for example, ink stuck to the side surface of the head 16A. On the other hand, water with relatively high surface tension spreads less, but does not dry well.

As such, when the cleaning liquid and water are both used, it is possible to use both the advantage of the cleaning liquid and the advantage of water and effectively clean a gap 80 between the heads 16A.

Figure 12:
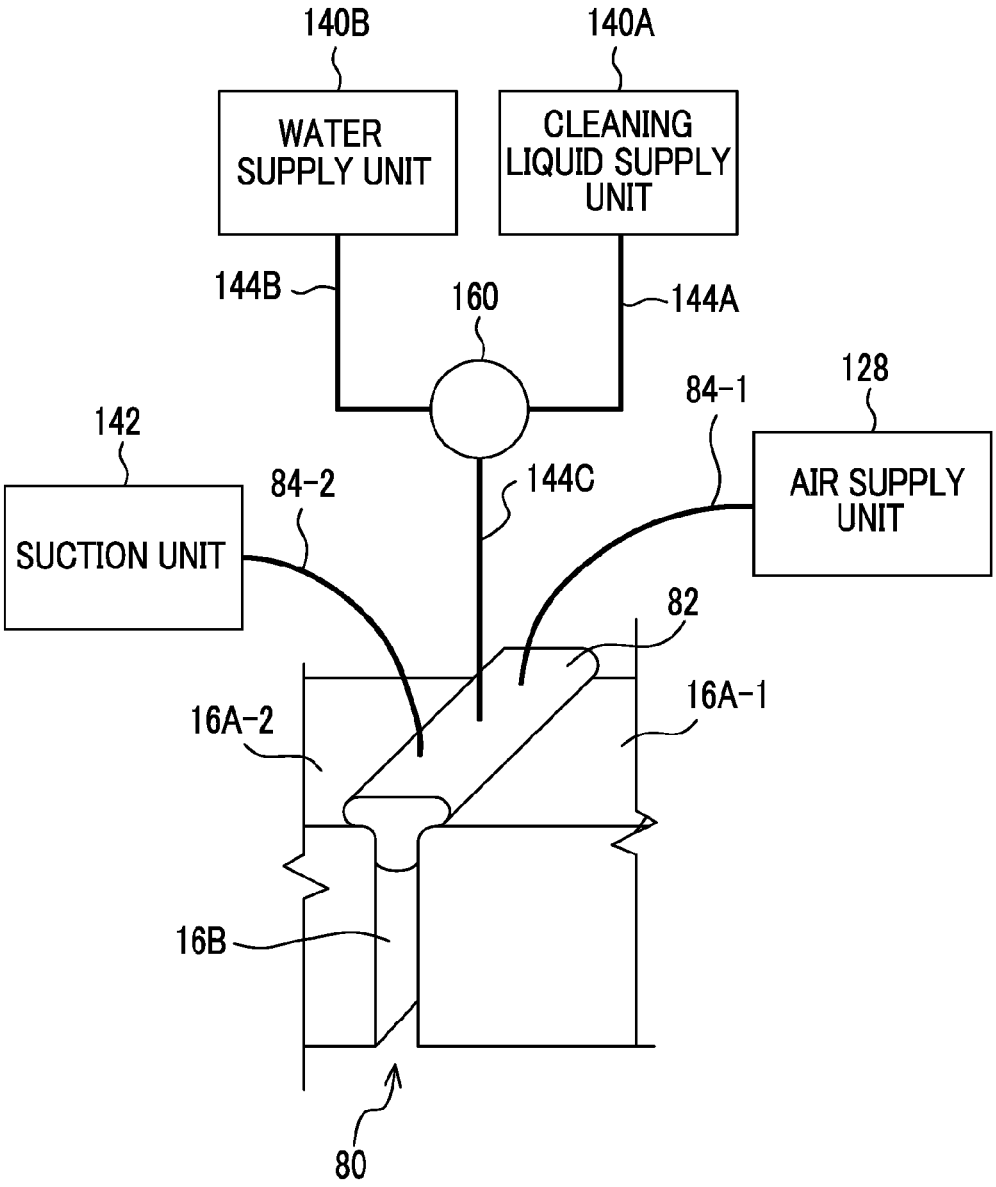
FIG. 12 is a diagram illustrating another example of the structure of the cleaning between the heads.

FIG. 12 is a diagram illustrating another example of the structure of the cleaning between the heads. In the aspect shown in FIG. 12, a liquid switching unit 160 (a component of a liquid switching unit) which switches the supply of the liquid between the supply of the cleaning liquid and the supply of water is provided and a tube 144C common to the cleaning liquid and water is held in a tube supporting member 82.

The liquid switching unit 160 is a switching valve (control valve) and switches between the supply of the cleaning liquid and the supply of water on the basis of a control signal from a system control unit 102.

According to this aspect, it is possible to reduce the number of tubes held (inserted into the gap 80 between the heads 16A) in the tube supporting member 82.

<Control Flow>

Figure 13:
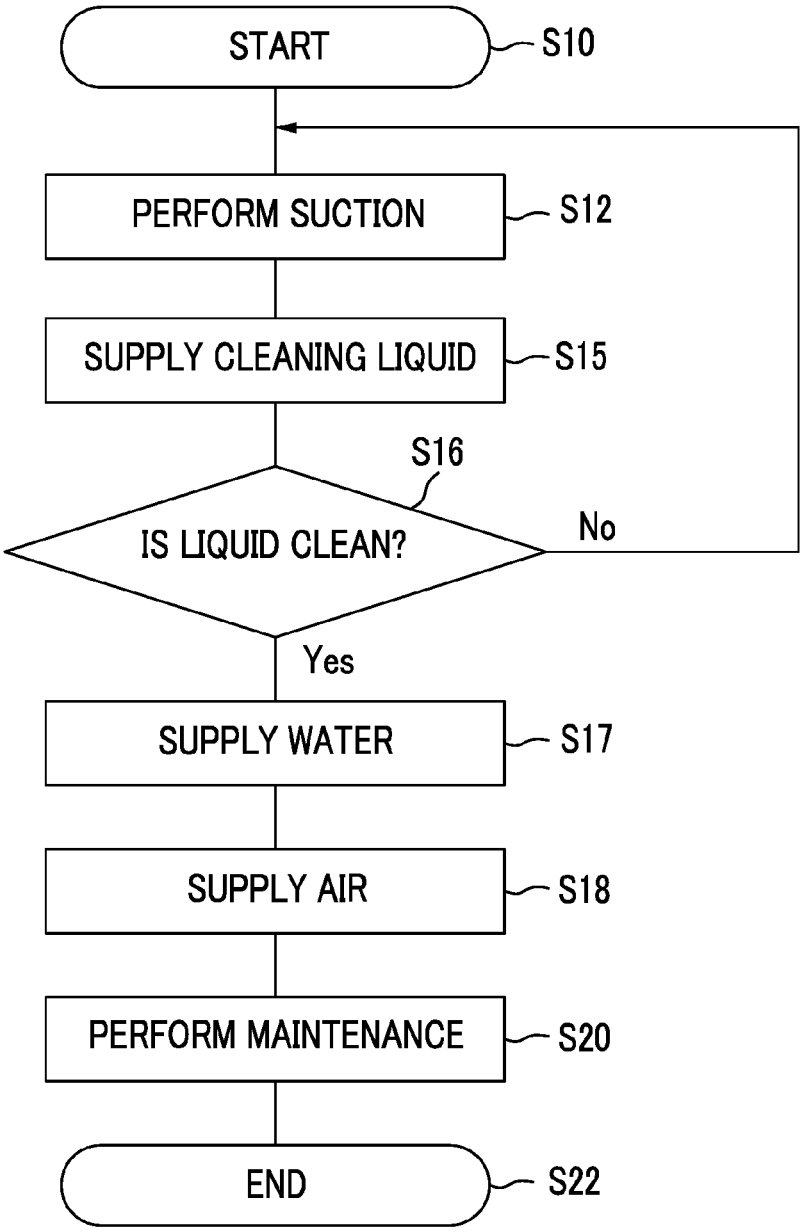
FIG. 13 is a flowchart illustrating the flow of the cleaning between the heads.

FIG. 13 is a flowchart illustrating the flow of the cleaning between the heads according to this embodiment. The flow shown in FIG. 13 includes a cleaning liquid supply process (Step S15) instead of Step S14 (liquid supply process) in the flow shown in FIG. 9.

A water supply process (Step S17) is added between Step S16 (contamination determining process) and Step S18 (air supply process).

According to the third embodiment, since a cleaning liquid and water are both used, it is possible to improve the performance of removing, for example, ink in a gap 80 between heads 16A and the performance of removing the liquid (the cleaning liquid and water) supplied to the gap 80 between the heads 16A.

[Fourth Embodiment]

Next, a fourth embodiment of the invention will be described.

Figure 14:
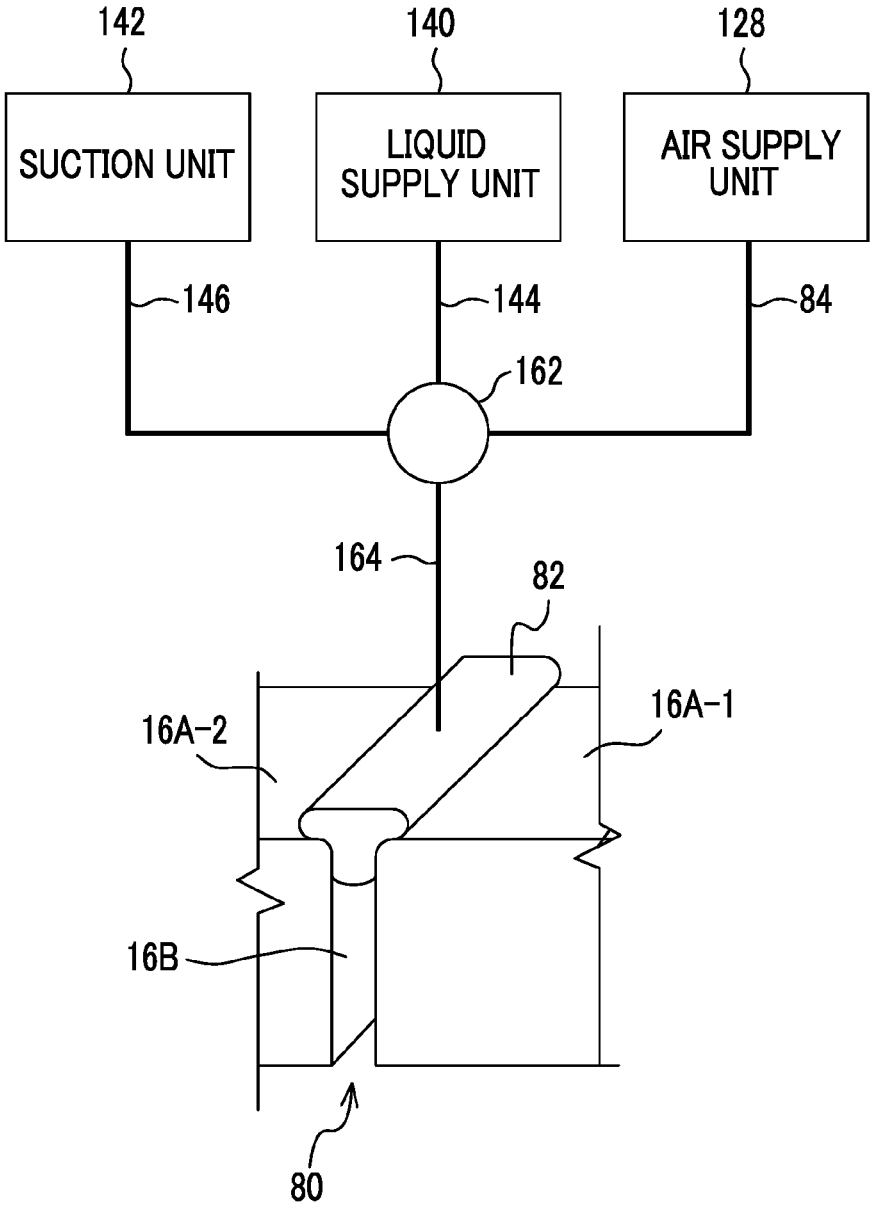
FIG. 14 is a diagram illustrating an example of the configuration of cleaning between heads in an ink-jet recording device according to a fourth embodiment of the invention.
Figure 15:
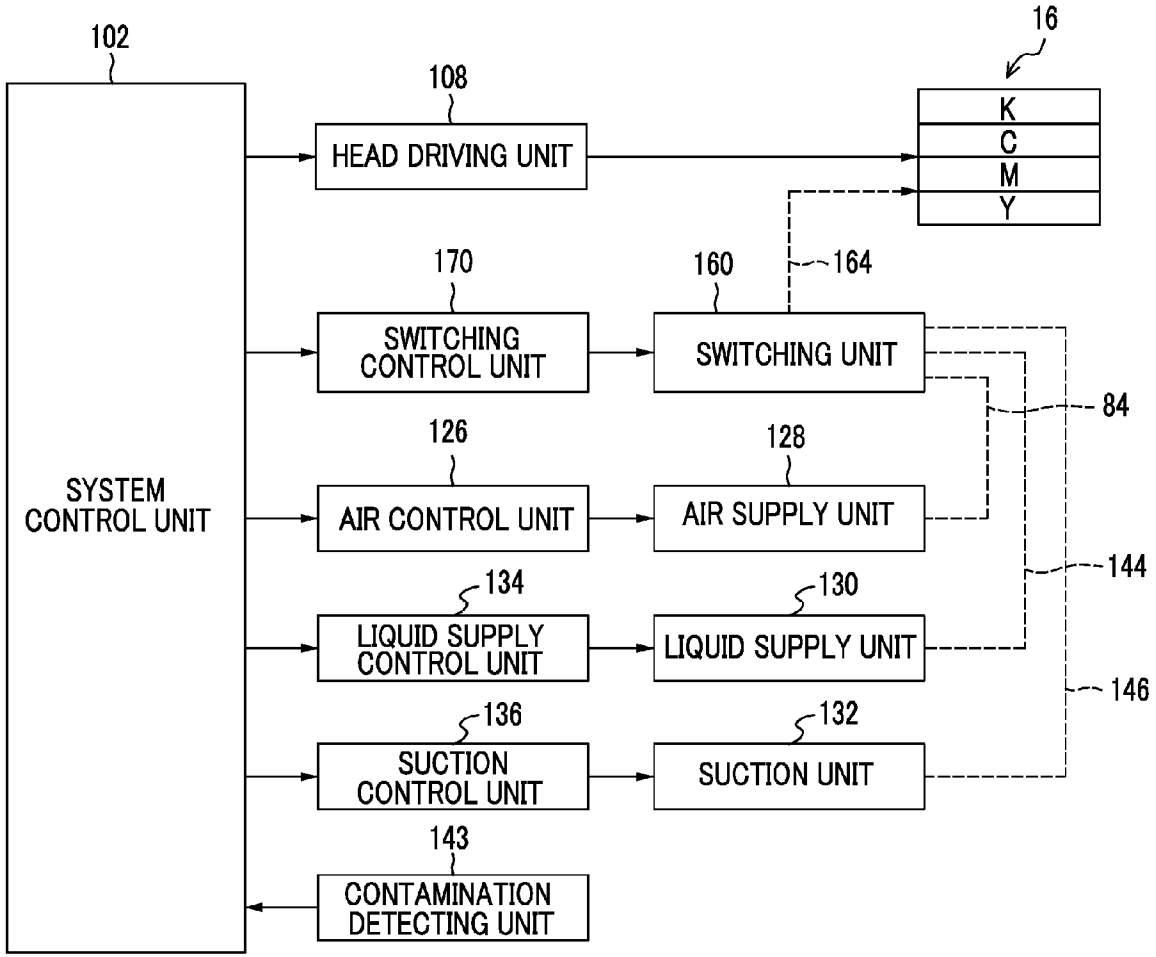
FIG. 15 is a block diagram illustrating the schematic structure of a control system.

FIG. 14 is a diagram illustrating an example of the configuration of cleaning between heads in an ink-jet recording device according to the fourth embodiment of the invention. FIG. 15 is a block diagram illustrating the schematic structure of a control system according to this embodiment.

In the aspect shown in FIGS. 14 and 15, the supply of air, the supply of a liquid, and suction can be selectively switched. That is, an air supply tube 84, a liquid supply tube 144, and a suction tube 146 are connected to a switching unit 162. The switching unit 162 is connected to one end of a tube 164 common to the supply of air, the supply of a liquid, and suction. The other end of the common tube 164 is connected to a gap 80 between heads 16A.

The switching unit 162 (a component of a switching unit) is a switching valve (control valve) and performs switching among the supply of air, the supply of a liquid, and suction through a switching control unit 170 (a component of the switching unit) on the basis of a control signal from a system control unit 102.

According to this aspect, it is possible to perform switching among the supply of air, the supply of a liquid, and suction on the base side of the tube 164 connected to the gap 80 between the heads 16A and reduce the number of tubes supported by a tube supporting member 82. In addition, it is possible to respond to a case in which the tube supporting member 82 is not capable of supporting a large number of tubes.

In addition, it is possible to prevent, for example, the sucked ink from becoming stuck in the tube 164 in the vicinity of the head 16A. Even when the tube 164 becomes clogged, a liquid or air is supplied to unclog the tube.

Figure 16A:
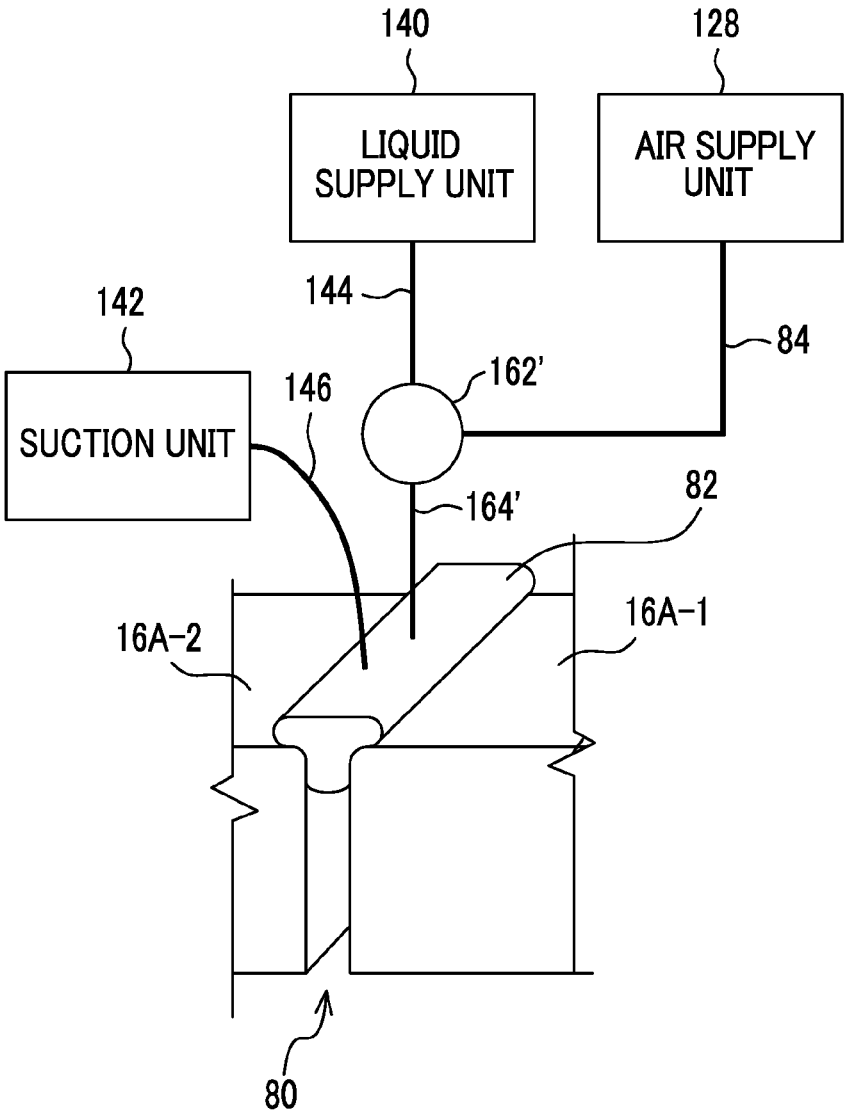
FIG. 16A and 16B are diagrams illustrating another example of the structure of the cleaning between the heads.
Figure 16B:
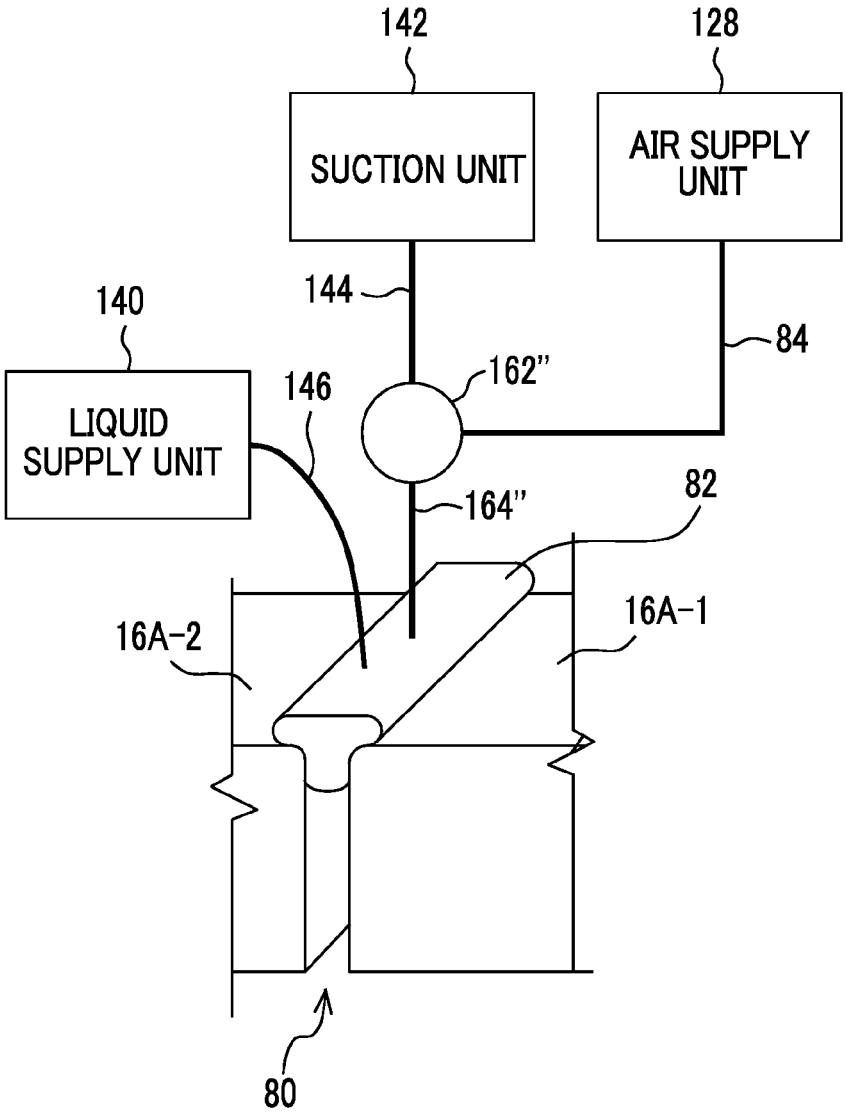

FIGS. 16A and 16B are diagrams illustrating another example of the cleaning between the heads according to this embodiment. In the aspect shown in FIG. 16A, a switching unit 162' (gas and liquid switching unit) can switch between the supply of air and the supply of a liquid. In the aspect shown in FIG. 16B, a switching unit 162" (supply switching unit) can switch between the supply of air and suction.

As such, it is possible to switch between two functions among three functions, that is, an air supply function, a liquid supply function, and a suction function.

[Fifth Embodiment]

Figure 17:
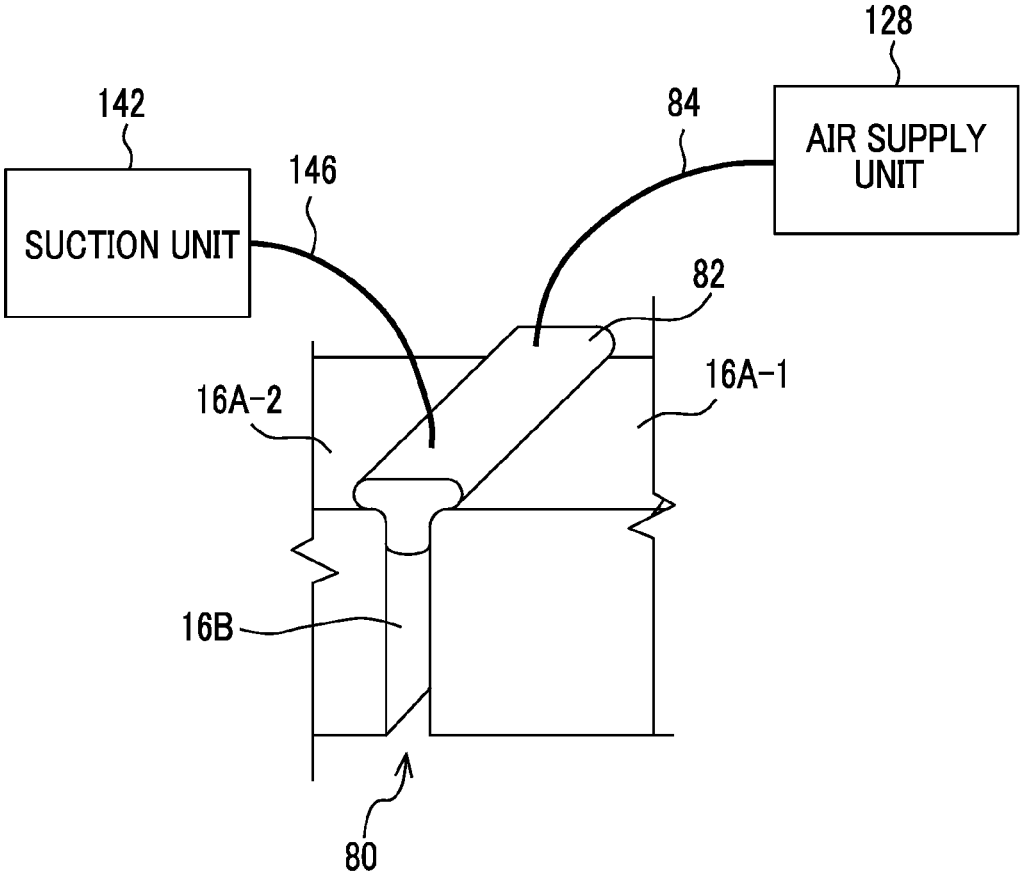
FIG. 17 is a diagram illustrating an example of the configuration of cleaning between heads in an ink-jet recording device according to a fifth embodiment of the invention.

Next, a fifth embodiment of the invention will be described. FIG. 17 is a diagram illustrating an example of cleaning between heads in an ink-jet recording device according to the fifth embodiment of the invention. In the aspect shown in FIG. 17, the ink-jet recording device has a suction function in addition to an air supply function.

When a suction hole is not close to the liquid in a gap 80 between heads 16A, it is difficult to suck the liquid. Air is supplied to blow the liquid that is difficult to suck. Therefore, it is possible to completely remove, for example, ink in the gap 80 between the heads 16A.

As shown in FIG. 16B, the supply of air and suction may be selectively changed by the switching unit 162".

[Sixth Embodiment]

Figure 18A:
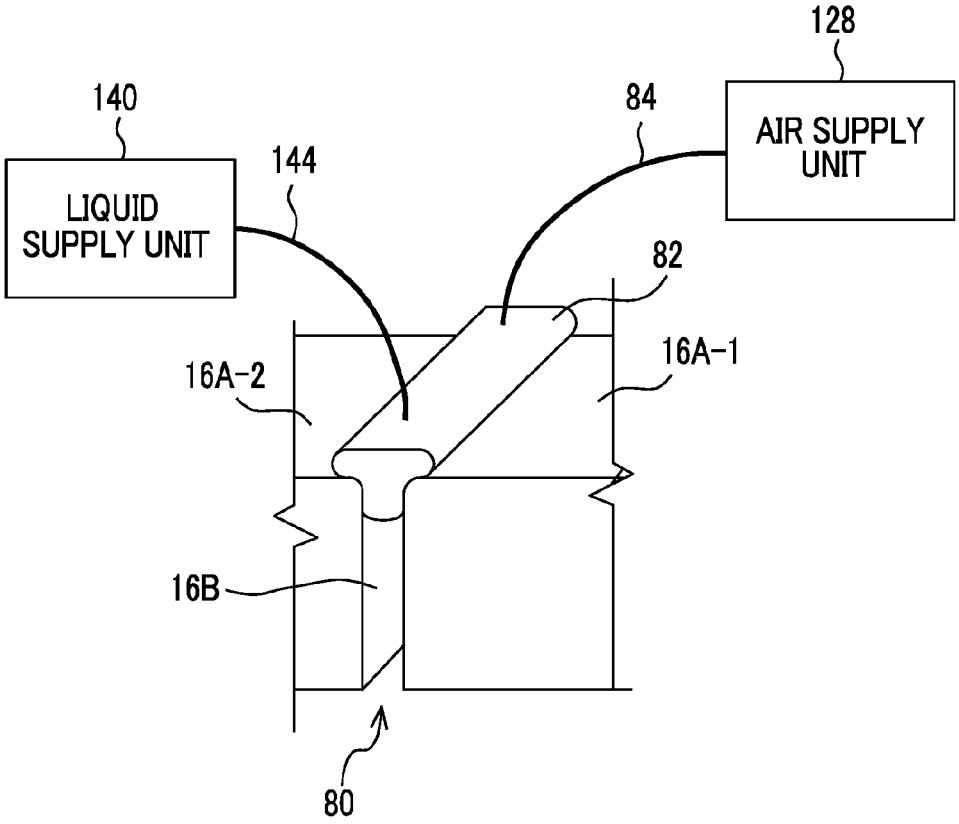
FIG. 18A and 18B are diagrams illustrating examples of the configuration of cleaning between heads in an ink-jet recording device according to a sixth embodiment of the invention.
Figure 18B:
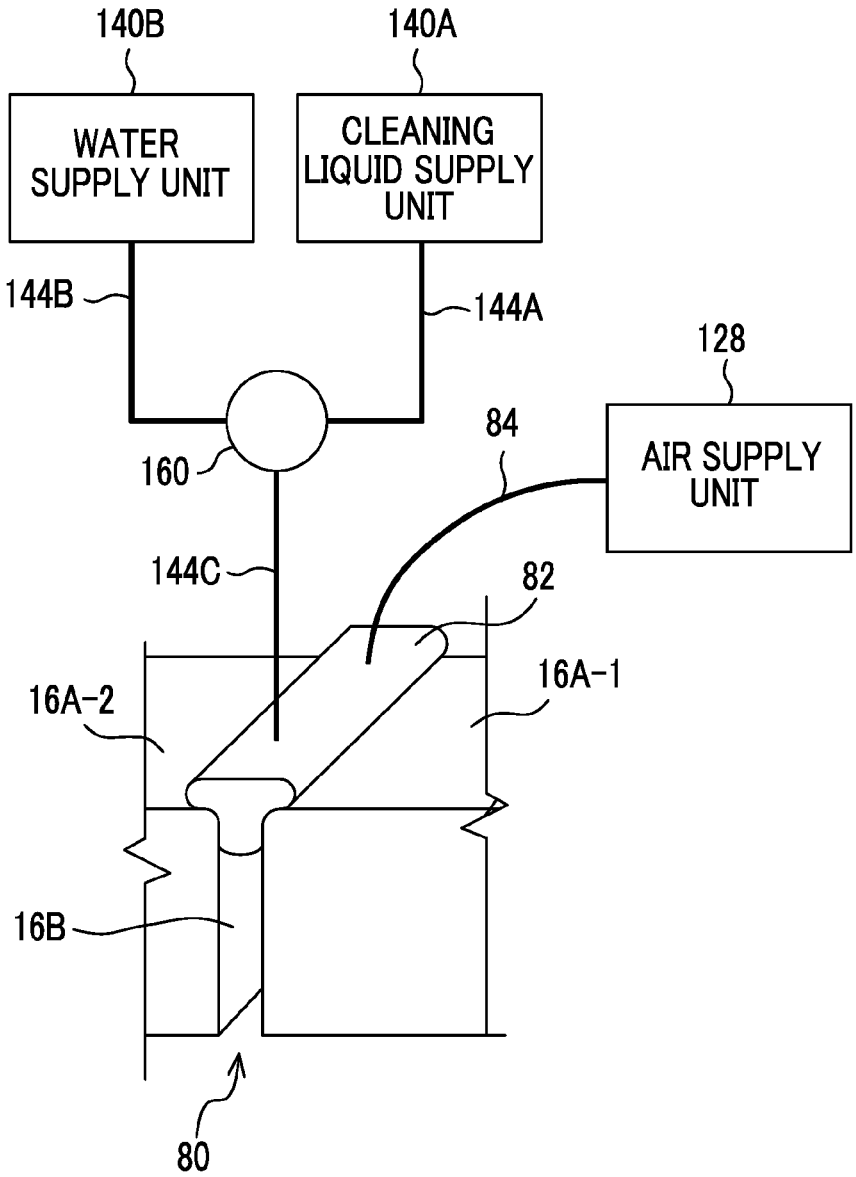

Next, a sixth embodiment of the invention will be described. FIG. 18A is a diagram illustrating an example of cleaning between heads in an ink-jet recording device according to the sixth embodiment of the invention. FIG. 18B is a diagram illustrating another example of the cleaning between the heads according to this embodiment. In the aspect shown in FIG. 18A, the ink-jet recording device has a liquid supply function in addition to an air supply function. As shown in FIG. 16A, the supply of air and the supply of a liquid may be selectively changed by the switching unit 162'.

In the aspect shown in FIG. 18B, the ink-jet recording device includes a cleaning liquid supply unit 140A and a water supply unit 140B as a liquid supply unit. A liquid switching unit 160 can switch between the supply of a cleaning liquid and the supply of water.

In the aspects shown in FIGS. 18A and 18B, the cleaning liquid supply unit 140A or the water supply unit 140B may be used as the liquid supply unit 140.

During the removal of the liquid in a gap 80 between heads 16A, when there is a problem in blowing the condensed ink, it is possible to dilute the condensed ink with the cleaning liquid or water.

[Another Example of Structure of Tube]

Figure 19A:
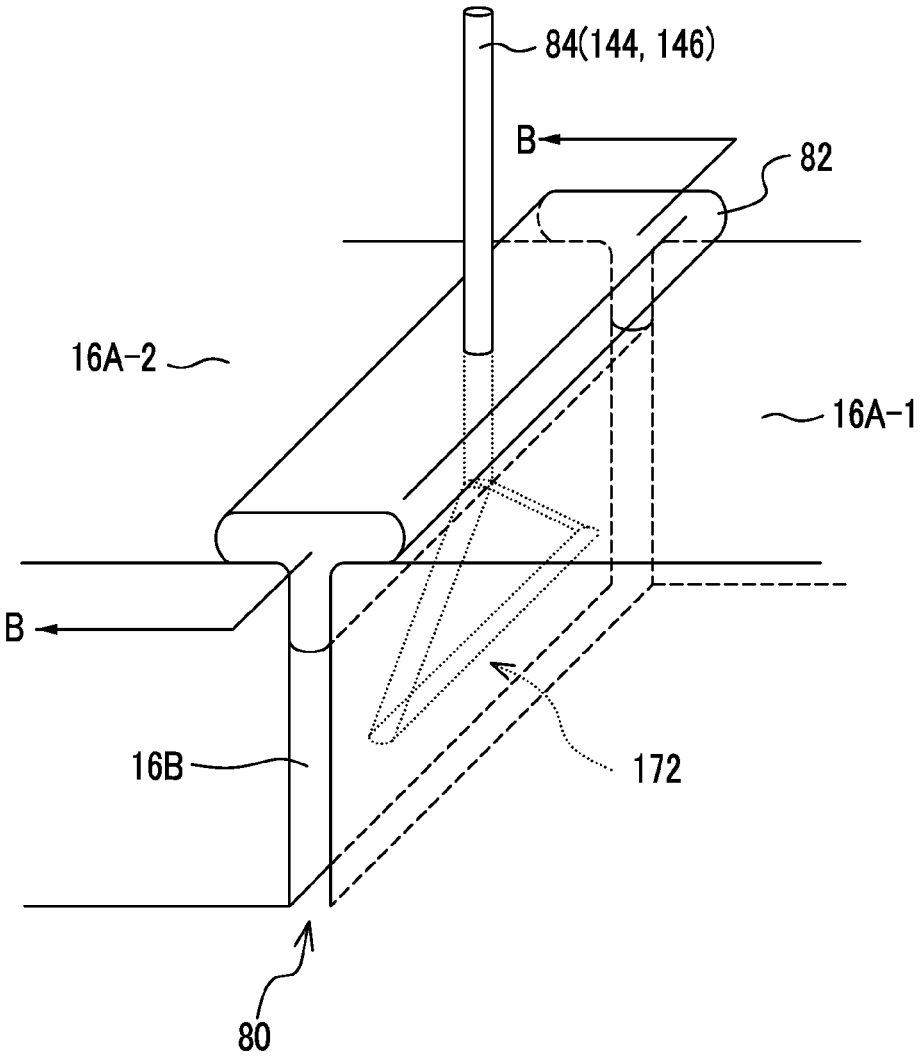
FIG. 19A is a perspective view illustrating an example of the structure of a tube.
Figure 19B:
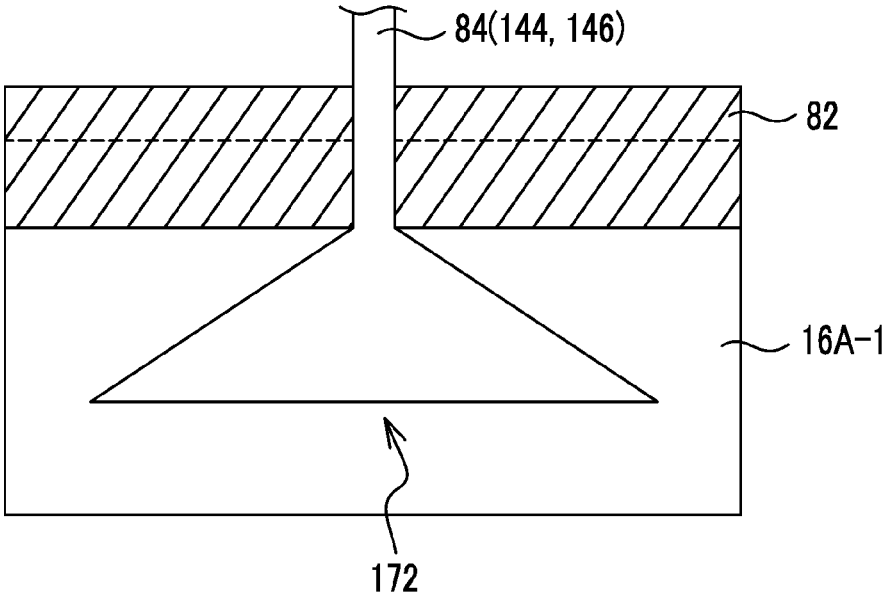
FIG. 19B is a cross-sectional view taken along line B-B of FIG. 19.

FIG. 19A is a perspective view illustrating an example of the structure of a tube such as an air supply tube 84. FIG. 19B is a cross-sectional view taken along the line B-B of FIG. 19A. The tube shown in FIGS. 19A and 19B has a funnel shape in which one end of the tube inserted into the gap 80 between the heads 16A has a wide opening (represented by a dashed line in FIGS. 19A).

That is, the length (maximum length) of an opening 172 at one end of the tube which is inserted into the gap 80 between the heads 16A in the long axis direction corresponds to the length of the gap 80 between the heads 16A in the longitudinal direction and is more than the thickness (diameter) of a portion of the tube with a uniform thickness (width).

According to this structure, the supply of air, the supply of a liquid, and suction are performed between both ends (in the entire region) of the gap 80 between the heads 16A including both ends thereof in the longitudinal direction.

In particular, this structure may be applied to the tubes 164, 164', and 164" provided between the switching units 162, 162', and 162" and the gap 80 between the heads 16A in the aspect according to the fourth embodiment in which the supply of air, the supply of the liquid, and suction are switched, the aspect according to the fifth embodiment in which the supply of air and suction are switched, and the aspect according to the sixth embodiment in which the supply or air and the supply of the liquid are switched. In this case, improving the efficiency of air supply, liquid supply, and suction, is expected, as compared to an aspect in which a large number of small tubes are used for each function.

In some cases, it is difficult to supply (suck) a sufficient amount of air (liquid) depending on the diameter of the air supply tube 84. Therefore, in order to reduce the resistance of a flow path, such as the air supply tube 84, the overall diameter of the air supply tube 84 may be set to about several millimeters and a portion of the air supply tube 84 which is inserted into the tube supporting member 82 and the periphery thereof may be set to above several hundreds of micrometers.

That is, for example, the air supply tube 84 may be configured such that the length of a thin portion is a minimum and the remaining portion is a thick portion. In addition, a plurality of thin air supply tubes 84 may be used to reduce the resistance of the flow path, such as the air supply tube 84.

[Example of Structure of Side Surface of Head]

Figure 20:
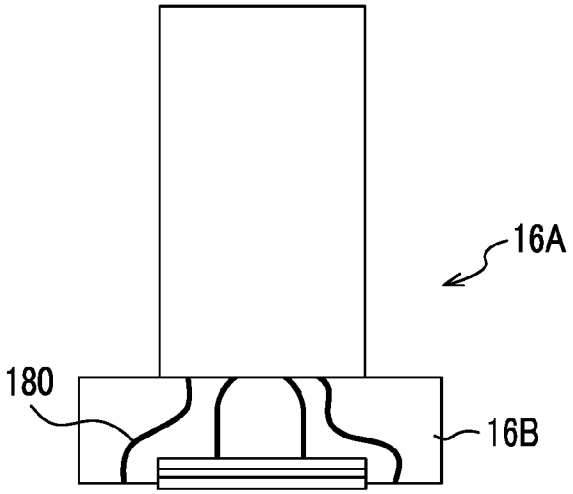
FIG. 20 is a diagram illustrating an example of the structure of the side surface of a head.

FIG. 20 is a diagram illustrating an example of the structure of the side surface (liquid-repellent surface) of the head 16A. As shown in FIG. 20, a groove 180 is provided in a side surface 16B of the head 16A, which makes it easy for air or a liquid (a cleaning liquid or water) supplied to the gap 80 between the heads 16A to flow on the side surface 16B of the head 16A.

[Combination with Maintenance Process]

The above-mentioned process of cleaning the gap 80 between the heads 16A may be combined with the maintenance process for the line head 16 (216). In this case, it is possible to effectively remove the liquid in the gap 80 between the heads 16A.

For example, in the aspect including the liquid supply unit 140 (for example, see FIG. 10), when the liquid ejection surface is wiped, a liquid is supplied to the gap 80 between the heads 16A, which makes it easy to remove ink residue on the liquid ejection surface.

Air is supplied to wipe the liquid ejection surface while blowing the liquid in the gap 80 between the heads 16A, thereby removing the liquid. Therefore, the ejection surface is not contaminated with ink which is blown by air and the blown ink does not return to the gap 80 between the heads 16A.

The cleaning liquid is supplied while air is being supplied. Therefore, it is possible to reduce the amount of liquid supplied to the gap 80 between the heads 16A.

In the line head 16 (see FIG. 2) in which three or more heads 16A are provided and there are a plurality of gaps 80 among the heads 16A, the supply of air, the supply of a liquid, and suction are performed at the time when the gap 80 between the heads 16A reaches the position of the web 66 (wiping member).

[Example of Structure of Another Device]

Figure 21:
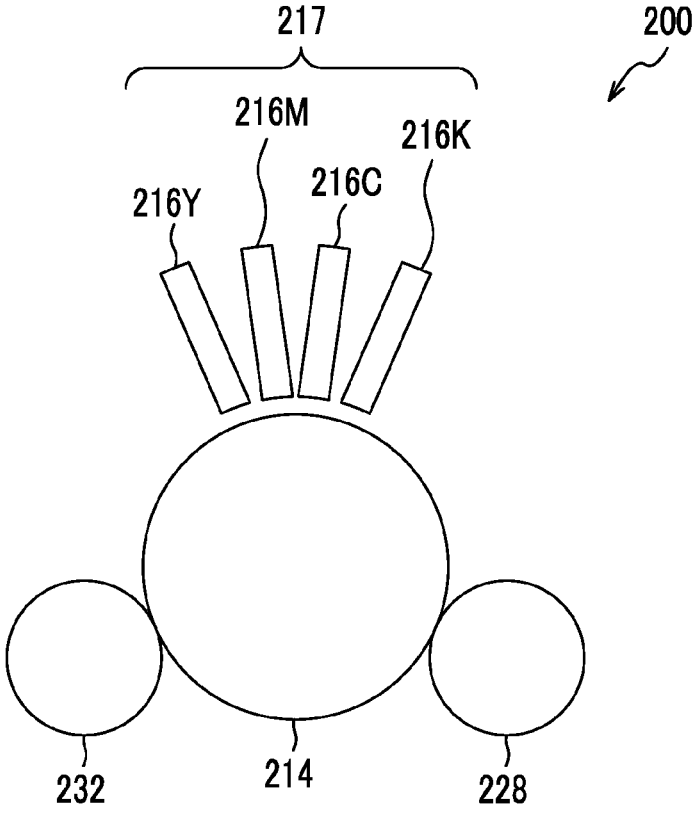
FIG. 21 is a diagram illustrating the structure of another device.

FIG. 21 is a diagram illustrating the structure of another device. An ink-jet recording device 200 shown in FIG. 21 is an impression cylinder transport type in which a recording medium is transported along the outer circumferential surface of an impression cylinder 214 while being held on the outer circumferential surface of the impression cylinder 214.

The recording medium which is transported from a recording medium supply unit (not shown) to a transfer cylinder 228 is transported immediately below a printing unit 217 while being held on the outer circumferential surface of the impression cylinder 214. Color inks are discharged from line heads 216K, 216C, 216M, and 216Y of the printing unit 217 onto the recording medium and a desired image is formed on the recording medium.

The line heads 216K, 216C, 216M, and 216Y shown in FIG. 21 are arranged so as to be inclined with respect to the horizontal plane such that the liquid ejection surfaces thereof are perpendicular to the normal line of the outer circumferential surface of the impression cylinder 214. The distance (clearance) between the recording medium and the liquid ejection surface is maintained to be constant by this structure.

The recording medium having the image formed thereon is transported from the impression cylinder 214 to a transfer cylinder 232. Then, predetermined processes (for example, a drying process and a fixing process) are performed for the recording medium and the recording medium is discharged from a discharge unit. In addition, pre-processing (for example, a processing liquid giving process and a heating process) may be performed before an image is formed by the printing unit 217.

The printing unit 217, a control system, and a maintenance processing unit of the ink-jet recording device 200 shown in FIG. 21 may have the same structure as those in the ink-jet recording device 10.

The application range of the invention is not limited to the ink-jet recording device which forms a color image on a recording medium. For example, the invention can be widely applied to a liquid ejection device which ejects a liquid onto a medium using an ink-jet method, such as a pattern forming device which forms a predetermined pattern (a mask pattern or a wiring pattern) with a functional liquid including resin particles or metal particles.

In addition, components may be appropriately changed, added, and removed without departing from the scope and spirit of the invention.

[The Invention Disclosed in The Specification]

As can be seen from the above-described embodiments of the invention, the specification includes various technical ideas including at least the following aspects.

(First Aspect): A liquid ejection device includes: a line head which includes a plurality of heads connected to each other in a longitudinal direction and in which a liquid-repellent treatment is performed for a side surface of each head facing an adjacent head; a tube supporting member that is provided between adjacent heads on a side opposite to a liquid ejection surface of the head and supports a tube having one end inserted between the heads; and a gas supply unit that is connected to the other end of the tube and supplies gas between the heads from the one end of the tube.

According to this aspect, in the liquid ejection device including the line head in which a plurality of heads are connected to each other, gas is supplied between adjacent heads to blow, for example, mist between the heads. Therefore, it is possible to effectively remove, for example, mist between the heads.

(Second Aspect): The liquid ejection device may further include: a liquid supply unit that supplies a liquid between the heads; and a suction unit that performs suction between the heads.

According to this aspect, since the supply of the liquid and suction are performed in addition to the supply of air, the head is effectively cleaned.

(Third Aspect): The liquid ejection device may further include: a switching unit that selectively switches connection between a gap between the heads, and a gas supply tube connected to the gas supply unit, a liquid supply tube connected to the liquid supply unit, and a suction tube connected to the suction unit.

According to this aspect, in the cleaning between the heads, the supply of gas, the supply of the liquid, and suction are selectively switched to effectively perform the cleaning between the heads.

According to this aspect, it is preferable that a common tube be supported by the tube supporting member.

(Fourth Aspect): At least two gas supply tubes may be provided, and the gas supply tubes may be arranged at both ends of a gap between the heads in a lateral direction of the line head.

According to this aspect, since gas is supplied from both ends, it is possible to reliably remove the liquid between the heads.

(Fifth Aspect): The liquid ejection device may further include a drying unit that performs a drying process for the gas supplied between the heads from the gas supply unit.

According to this aspect, it is possible to dry the gap between the heads and prevent the deterioration of an adhesive exposed from the side surface of the head.

(Sixth Aspect): In the liquid ejection device, the liquid supply unit may include: a cleaning liquid supply unit that supplies a cleaning liquid between the heads; and a water supply unit that supplies water between the heads.

According to this aspect, since the cleaning liquid with relatively low surface tension spreads to the side surface of the head, the liquid stuck to the side surface of the head is reliably removed. In addition, water with relatively high surface tension is dried well and a liquid is prevented from remaining between the heads (the side surfaces of the heads).

(Seventh Aspect): The liquid ejection device may further include a liquid switching unit that selectively switches connection between a gap between the heads, and the cleaning liquid supply unit and the water supply unit.

According to this aspect, the number of tubes supported by the tube supporting member does not increase.

(Eighth Aspect): The liquid ejection device may further include a suction unit that performs suction between the heads.

In this aspect, it is preferable that the gas supply unit supply the gas after the suction unit performs suction.

(Ninth Aspect): The liquid ejection device may further include a supply and suction switching unit that switches connection between a gap between the heads, and a gas supply tube connected to the gas supply unit and a suction tube connected to the suction unit.

In this aspect, it is preferable that the gas supply tube and the suction tube be commonly used between the gap between the heads and the supply and suction switching unit.

(Tenth Aspect): The liquid ejection device may further include a liquid supply unit that supplies a liquid between the heads.

In this aspect, it is preferable that the gas supply unit supply the gas after the liquid supply unit supplies the liquid.

(Eleventh Aspect): The liquid ejection device may further include a gas and liquid switching unit that switches connection between a gap between the heads, and a gas supply tube connected to the gas supply unit and a liquid supply tube connected to the liquid supply unit.

In this aspect, it is preferable that the gas supply tube and the liquid supply tube be commonly used between the gap between the heads and the gas and liquid switching unit.

(Twelfth Aspect): In the liquid ejection device, the liquid supply unit may include: a cleaning liquid supply unit that supplies a cleaning liquid between the heads; and a water supply unit that supplies water between the heads.

According to this aspect, since the cleaning liquid with relatively low surface tension spreads to the side surface of the head, for example, the mist stuck to the side surface of the head is reliably removed. In addition, water with relatively high surface tension is dried well and a liquid is prevented from remaining between the heads (the side surfaces of the heads).

(Thirteenth Aspect): The liquid ejection device may further include a liquid switching unit that switches connection between a gap between the heads, and the cleaning liquid supply unit and the water supply unit.

In this aspect, it is preferable that the cleaning liquid supply tube and the water supply tube be commonly used between the gap between the heads and the liquid switching unit.

(Fourteenth Aspect): The liquid ejection device may further include a wiping unit that wipes the liquid ejection surface of the head while the gas is being supplied between the heads from the gas supply unit.

According to this aspect, the wiping unit removes the liquid which is discharged between the heads by the supply of gas and the internal contamination of the device due to the liquid is prevented.

(Fifteenth Aspect): In the liquid ejection device, the wiping unit may wipe the liquid ejection surface of the head while the gas is being supplied between the heads from the gas supply unit and a liquid is being supplied from the liquid supply unit.

According to this aspect, since the liquid ejection surface is wetted by the liquid supplied between the heads, the performance of wiping the liquid ejection surface is improved.

In addition, since the liquid is supplied between the heads while gas is being supplied between the heads, it is possible to reduce the amount of liquid supplied between the heads.

(Sixteenth Aspect): There is provided a method of maintaining a line head which includes a plurality of heads connected to each other in a longitudinal direction and in which a liquid-repellent treatment is performed for a side surface of each head facing an adjacent head. The method includes supplying gas between the heads through a tube which is supported by a tube supporting member provided between adjacent heads on a side opposite to a liquid ejection surface of the head and has one end inserted between the heads.

In this aspect, it is preferable that the maintenance method include moving a wiping unit that wipes the liquid ejection surface of the line head to a position immediately below a gap between the heads when the supply of the gas is performed.

In addition, it is preferable that the maintenance method include wiping the liquid ejection surface of the line head after the supply of the gas.

(Seventeenth Aspect): The maintenance method may further include: performing suction between the heads; and supplying a liquid between the heads after the suction. The supply of the gas may be performed after the supply of the liquid.

In this aspect, it is preferable that the maintenance method include wiping the liquid ejection surface of the line head after the supply of the gas.

(Eighteenth Aspect): The maintenance method may further include detecting a degree of contamination of the liquid supplied between the heads after the supply of the liquid. When the detected degree of contamination of the liquid supplied between the heads is less than a reference value, the supply of the gas may be performed.

According to this aspect, the cleaning state between the heads is determined on the basis of the degree of contamination of the liquid supplied between the heads. After the contamination between the heads is removed to some extent, gas is supplied to remove the liquid remaining between the heads. Therefore, it is possible to change the gap between the heads to a preferred normal state.

What is claimed is:

1. A liquid ejection device comprising:

a line head which includes a plurality of heads connected to each other in a longitudinal direction and in which a liquid-repellent treatment is performed for a side surface of each head facing an adjacent head;

a tube supporting member that is provided between adjacent heads on a side opposite to a liquid ejection surface of the head and supports a tube having one end inserted between the heads; and a gas supply unit that is connected to the other end of the tube and supplies gas between the heads from the one end of the tube.

2. The liquid ejection device according to claim 1, further comprising:

a liquid supply unit that supplies a liquid between the heads; and a suction unit that performs suction between the heads.

3. The liquid ejection device according to claim 2, further comprising:

a switching unit that selectively switches connection between a gap between the heads, and a gas supply tube connected to the gas supply unit, a liquid supply tube connected to the liquid supply unit, and a suction tube connected to the suction unit.

4. The liquid ejection device according to claim 3, wherein at least two gas supply tubes are provided, and the gas supply tubes are arranged at both ends of the gap between the heads in a lateral direction of the line head.

5. The liquid ejection device according to claim 2, wherein at least two gas supply tubes are provided, and the gas supply tubes are arranged at both ends of a gap between the heads in a lateral direction of the line head.

6. The liquid ejection device according to claim 2, further comprising:

a drying unit that performs a drying process for the gas supplied between the heads from the gas supply unit.

7. The liquid ejection device according to claim 1, further comprising:

a drying unit that performs a drying process for the gas supplied between the heads from the gas supply unit.

8. The liquid ejection device according to claim 1, wherein the liquid supply unit includes:

a cleaning liquid supply unit that supplies a cleaning liquid between the heads; and a water supply unit that supplies water between the heads.

9. The liquid ejection device according to claim 8, further comprising:

a liquid switching unit that selectively switches connection between a gap between the heads, and the cleaning liquid supply unit and the water supply unit.

10. The liquid ejection device according to claim 1, further comprising:

a suction unit that performs suction between the heads.

11. The liquid ejection device according to claim 10, further comprising:

a supply and suction switching unit that switches connection between a gap between the heads, and a gas supply tube connected to the gas supply unit and a suction tube connected to the suction unit.

12. The liquid ejection device according to claim 1, further comprising:

a liquid supply unit that supplies a liquid between the heads.

13. The liquid ejection device according to claim 12, further comprising:

a gas and liquid switching unit that switches connection between a gap between the heads, and a gas supply tube connected to the gas supply unit and a liquid supply tube connected to the liquid supply unit.

14. The liquid ejection device according to claim 12, wherein the liquid supply unit includes:

a cleaning liquid supply unit that supplies a cleaning liquid between the heads; and a water supply unit that supplies water between the heads.

15. The liquid ejection device according to claim 14, further comprising:

a liquid switching unit that switches connection between a gap between the heads, and the cleaning liquid supply unit and the water supply unit.

16. The liquid ejection device according to claim 1, further comprising:

a wiping unit that wipes the liquid ejection surface of the head while the gas is being supplied between the heads from the gas supply unit.

17. The liquid ejection device according to claim 16, wherein the wiping unit wipes the liquid ejection surface of the head while the gas is being supplied between the heads from the gas supply unit and a liquid is being supplied from a liquid supply unit.

18. A method of maintaining a line head which includes a plurality of heads connected to each other in a longitudinal direction and in which a liquid-repellent treatment is performed for a side surface of each head facing an adjacent head, comprising:

supplying gas between the heads through a tube which is supported by a tube supporting member provided between adjacent heads on a side opposite to a liquid ejection surface of the head and has one end inserted between the heads.

19. The maintenance method according to claim 18, further comprising:

performing suction between the heads; and supplying a liquid between the heads after the suction, wherein the supply of the gas is performed after the supply of the liquid.

20. The maintenance method according to claim 19, further comprising:

detecting a degree of contamination of the liquid supplied between the heads after the supply of the liquid, wherein, when the detected degree of contamination of the liquid supplied between the heads is less than a reference value, the supply of the gas is performed.

* * * * *